US007226033B2

(12) United States Patent
Foucher et al.

(10) Patent No.: US 7,226,033 B2
(45) Date of Patent: Jun. 5, 2007

(54) TRANSPORTABLE FORMS FOR CONCRETE BUILDINGS AND COMPONENTS AND METHODS OF MANUFACTURE AND USE OF SAME

(75) Inventors: Brian R. Foucher, Harrisville, NH (US); Anthony Collins, St. Thomas, VI (US)

(73) Assignee: Good Ideas, LLC, St. Thomas, VI (US)

( * ) Notice: Subject to any disclaimer, the term of this patent is extended or adjusted under 35 U.S.C. 154(b) by 399 days.

(21) Appl. No.: 10/862,790

(22) Filed: Jun. 7, 2004

(65) Prior Publication Data

US 2005/0284093 A1 Dec. 29, 2005

(51) Int. Cl.
*E04G 11/00* (2006.01)
*E04G 11/06* (2006.01)
*E04G 11/08* (2006.01)

(52) U.S. Cl. ..... 249/44; 249/45; 249/47; 249/192; 249/195; 52/284; 52/64; 52/270; 52/79.5; 52/319; 52/322

(58) Field of Classification Search ..... 52/591.2, 52/592.1, 592.6, 284, 426–428, 442, 562, 52/565, 568, 64–72, 111, 270, 79.1, 79.5, 52/302.1, 319, 323; 249/44–45, 47, 192, 249/195, 33, 190, 213, 216
See application file for complete search history.

(56) References Cited

U.S. PATENT DOCUMENTS 2,595,123 A * 4/1952 Callan ..... 52/745.05
2,765,497 A * 10/1956 Wilhelm ..... 52/70
3,482,005 A 12/1969 Quentin
3,555,751 A * 1/1971 Horgusen ..... 52/127.3
3,559,944 A * 2/1971 Clough ..... 249/36
3,633,325 A 1/1972 Bartoli
3,689,019 A 9/1972 Ferenc
3,719,012 A 3/1973 Lawrent
3,815,861 A 6/1974 Maier
3,952,463 A 4/1976 Lane
4,127,254 A 11/1978 Kahan (Continued)

OTHER PUBLICATIONS

Fifth International Conference on Space Structures, Expandable Structures formed by Hingid Plates, Aug. 19, 2002, 10-20, University of Surrey, U.S.

*Primary Examiner*—Jeanette Chapman
(74) *Attorney, Agent, or Firm*—Jones, Walker, Waechter, Poitevent, Carrere, & Denegre, L.L.P.

(57) ABSTRACT

A method for manufacture and assembly of a concrete structure includes manufacturing, at a first location, wall sections and floor/ceiling sections. The wall sections include interior form walls of adjustable separation, and may include interior and exterior finish features, interior rebar, electrical and water supply, and optional fabric forms. The floor/ceiling sections include forms that have adjustable components, and may include rebar, interior finish features, and electrical and heating components. Wall sections and floor/ceiling sections are rotatably and slidably/rotatably attached to one another to define structure segments. Structure segments may be placed in shipping containers for transport. Structure segments are transported to a construction site in a compact orientation, manipulated to an assembled position, and then concrete is inserted into forms defined by the segments and permitted to cure. Forms may be provided to permit formation of footings simultaneously with pouring of concrete for wall sections. Structure segments may be placed together to form structures.

29 Claims, 37 Drawing Sheets

U.S. PATENT DOCUMENTS 4,203,788 A 5/1980 Clear
4,375,010 A 2/1983 Mollenkopf
4,462,951 A 7/1984 Martin
4,465,257 A * 8/1984 Schimmel ..... 249/11
4,706,429 A 11/1987 Young
4,715,159 A 12/1987 Hijazi
4,730,422 A 3/1988 Young
4,765,109 A 8/1988 Boeshart
4,768,938 A 9/1988 Greeson
4,815,242 A 3/1989 Gilliland
4,862,660 A * 9/1989 Raymond ..... 52/220.2
4,866,891 A 9/1989 Young
4,885,888 A 12/1989 Young
4,889,310 A 12/1989 Boeshart
4,896,165 A 1/1990 Koizumi
4,916,879 A 4/1990 Boeshart
4,921,649 A 5/1990 Greeson
4,944,127 A 7/1990 Clear
4,957,272 A * 9/1990 Lee ..... 249/196
5,024,031 A 6/1991 Hoberman
5,039,058 A 8/1991 Boeshart
5,209,039 A 5/1993 Boeshart
5,224,321 A 7/1993 Fearn
5,267,420 A 12/1993 Segman
5,332,863 A 7/1994 Emmert
5,426,900 A 6/1995 Spinger
5,459,966 A * 10/1995 Suarez et al. ..... 52/34
5,596,844 A * 1/1997 Kalinowski ..... 52/79.5
5,794,393 A 8/1998 Fearn
5,882,540 A 3/1999 Farrington
5,922,236 A 7/1999 Zuhl
6,343,894 B1 2/2002 Fearn
6,523,312 B2 2/2003 Budge
6,532,701 B2 3/2003 Williams
6,568,141 B2 5/2003 Kremers
6,604,328 B1 8/2003 Paddock
6,658,810 B2 12/2003 DeLoach
6,681,539 B2 1/2004 Yost
6,688,066 B1 2/2004 Cottier
6,702,247 B2 3/2004 Takagi
6,915,613 B2 * 7/2005 Wostal et al. ..... 52/426
7,082,731 B2 * 8/2006 Patz et al. ..... 52/426
2003/0097801 A1 8/2003 Paddock
2003/0168575 A1 9/2003 Fearn

* cited by examiner 900
800
816
812
100
111
818
9A
9B
820
805
110
901
161

131
152
151
109
108
104

Fig. 35A
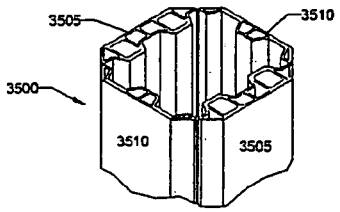
Fig. 35B
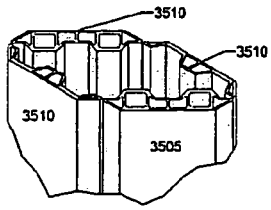
Fig. 35C
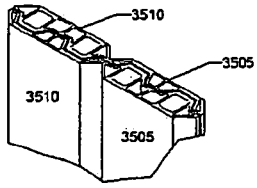
Fig. 35A
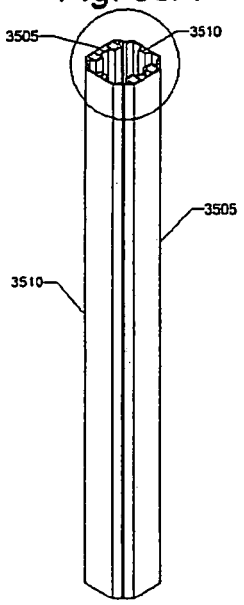
Fig. 35B
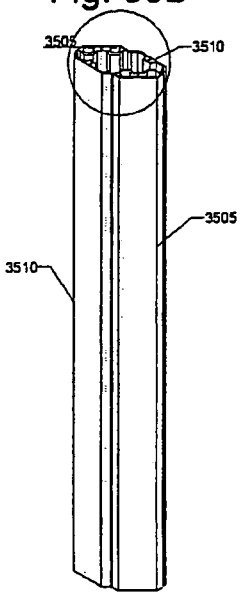
Fig. 35C
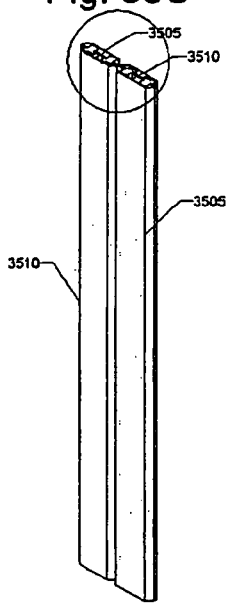
Fig. 35

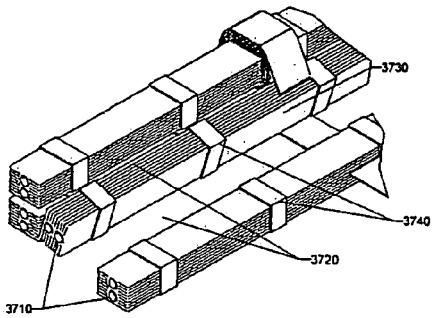
Fig. 37A
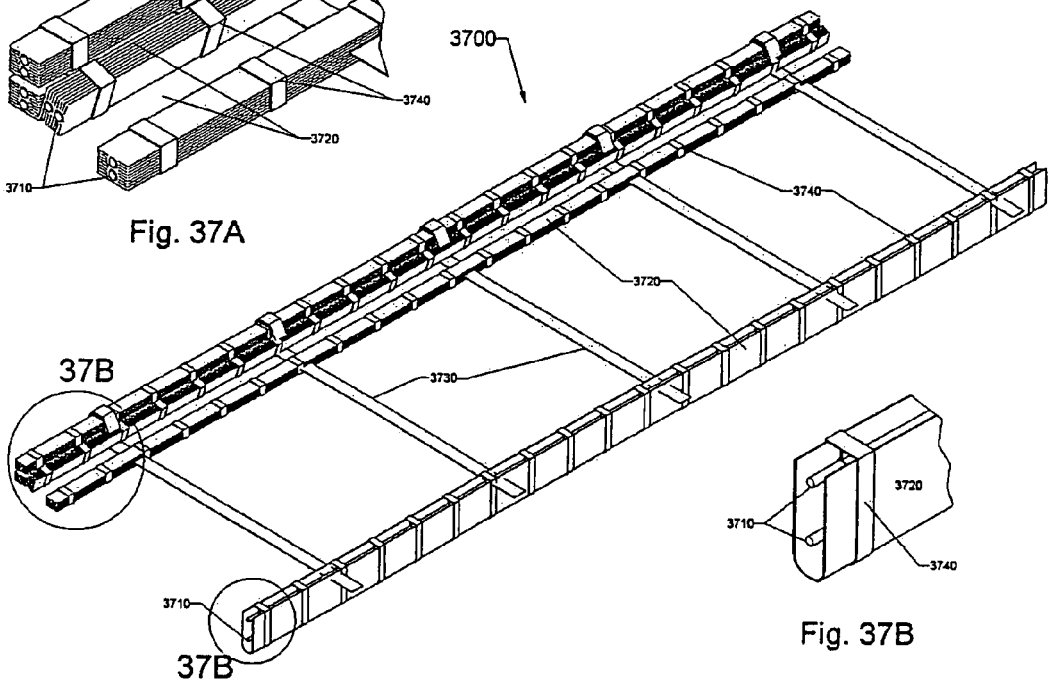
Fig. 37
Fig. 37B

TRANSPORTABLE FORMS FOR CONCRETE BUILDINGS AND COMPONENTS AND METHODS OF MANUFACTURE AND USE OF SAME

FIELD OF THE INVENTION

This invention is in the field of buildings, and in particular in the field of construction of buildings made at least in part of concrete.

BACKGROUND

The construction of buildings of concrete is typically accomplished by one of two methods. In a first method, forms are assembled at the construction site, typically from wood, in the shape of the desired object. The assembly of forms at the construction site is extremely labor intensive. Significant amounts of time are expended in the assembly of forms at the site, rendering construction schedules susceptible to delays from weather. The construction of forms corresponding accurately to plans requires careful measurement and alignment, which further increases the time involved in on-site processes.

In a second method, building elements of concrete, and generally of reinforced concrete, are constructed in a factory location. The use of a factory location overcomes some disadvantages, such as the need to properly align and construct forms at a construction site. However, transportation of concrete and reinforced concrete building elements is expensive, and is generally economical only for distances of, at most, a few hundred miles. The high cost derives from the fact that the concrete building elements are extremely heavy, often requiring specialized trucking equipment. The concrete building elements are also often not able to fit in standard truck beds, and require oversize load designations. Oversize load designations further increase the cost of transportation, by requiring special permits and accompanying vehicles to provide warnings.

It is an object of the invention to overcome the foregoing disadvantages of the prior art.

It is an advantage of the invention that the foregoing disadvantages of buildings and construction techniques of the prior art are overcome.

Additional objects and advantages of the invention will become evident from the detailed description which follows.

SUMMARY OF THE INVENTION

An apparatus of the invention comprises a wall or floor/ceiling section having two interior form surfaces, a shipping position in which the form surfaces are relatively in close proximity, and an assembled position in which the form surfaces are separated by a greater distance than in the shipping position, an interior space being defined between the form surfaces in the assembled position, the interior space being adapted to receive a flowable and setting material and to permit the flowable setting material to solidify in place, and hardware for alignment and attachment to adjacent sections.

In another aspect of the invention, a ceiling section for a structure has a substantially planar and continuous bottom form element, and components positioned on the bottom form element defining upright portions of a form, said components comprising adjustable components having a compact shipping orientation and an enlarged assembled orientation.

In another aspect of the invention, a structure segment has first and second wall sections, each of said wall sections having two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position, and a first horizontal section rotatably attached to said first and second wall sections, said horizontal section comprising a substantially planar and continuous bottom form element and components positioned on said bottom form element defining upright portions of a form, said components comprising adjustable components having a compact shipping orientation and an enlarged assembled orientation.

In another aspect of the invention, a method of construction of a structure, comprising the steps of positioning at a construction location first and second wall sections, each of said wall sections having two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position, and a first horizontal section rotatably attached to said first and second wall sections, said horizontal section comprising a substantially planar and continuous bottom form element and components positioned on said bottom form element defining upright portions of a form, said components comprising adjustable components having a compact shipping orientation and an enlarged assembled orientation; orienting said first and second wall sections and said first horizontal section in their assembled orientations; inserted a flowable structural material into said first and second wall sections and said first horizontal section, and permitting said flowable structural material to cure.

In another aspect of the invention, a method of construction of a structure includes positioning at a construction location, while in a compact shipping position, structure sections, the structure sections being positioned in an array; each of the structure sections has wall sections and a floor/ceiling sections; each of the wall sections has two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position; each of the floor/ceiling sections has a substantially planar and continuous bottom form element and components positioned on the bottom form element defining upright portions of a form, the components including adjustable components having a compact shipping orientation and an enlarged assembled orientation. Each of the structure sections is moved from its compact shipping position to an assembled position. A flowable, setting material is introduced into the structure sections, and the material is permitted to set, whereby the array of structure sections defines a structure, supported by the set material.

In another aspect of the invention, a method of construction of a structure includes positioning at a construction location, while in a compact shipping position, structure sections in an array. The structure sections include floor/ceiling sections and post and beam forms. The floor/ceiling sections each include a substantially planar and continuous bottom form element and components positioned on the bottom form element defining upright portions of a form, the components including adjustable components having a compact shipping orientation and an enlarged assembled orientation. The post and beam forms have a compact shipping orientation and an enlarged assembled orientation. Each of the structure sections is moved from the compact shipping position to an assembled position, and a flowable, setting material is introduced into the structure sections, and the material is permitted to set, whereby the array of structure sections defines a structure, supported by the set material, and including posts and beams.

According to another aspect of the invention, an article for providing horizontal elements in a structure has transverse elongated rigid members, fabric attached to the members and defining transverse troughs and longitudinal fabric strips attached to the transverse members, the transverse members and the fabric strips defining a lattice.

BRIEF DESCRIPTION OF THE DRAWINGS

FIGS. 35A–35C are isometric views of an article in accordance with the invention.

FIG. 37 is an isometric view of an article according to the invention, of which FIGS. 37A and 37B are details.

DETAILED DESCRIPTION OF EXEMPLARY EMBODIMENTS

A method of the invention includes, in one aspect, a method of construction of a structure. The method includes the steps of manufacture of sections for use as load-bearing floors and walls of a structure. The sections at least opposing interior form surfaces, which are generally planar and parallel. The separation between the opposing interior form surfaces is adjustable. The separation may be at a minimum in a folded orientation for shipment of the section. The separation may be at a greater distance in an assembly orientation. In an assembly orientation, the sections are adapted to receive a flowable, curable structural material, such as concrete, and to maintain the material in place until cured.

The sections may be constructed for self-alignment with adjacent sections. The sections may, in some embodiments, be rotatably attached to one another prior to assembly. The sections may have, in addition to surfaces, a structure to adjust the separation of the surfaces, and containing means for concrete, structural material, such as rebar, insulating material, and finish material, accommodation for utilities, wiring, ducts and pipes, and the like.

Figure 1:
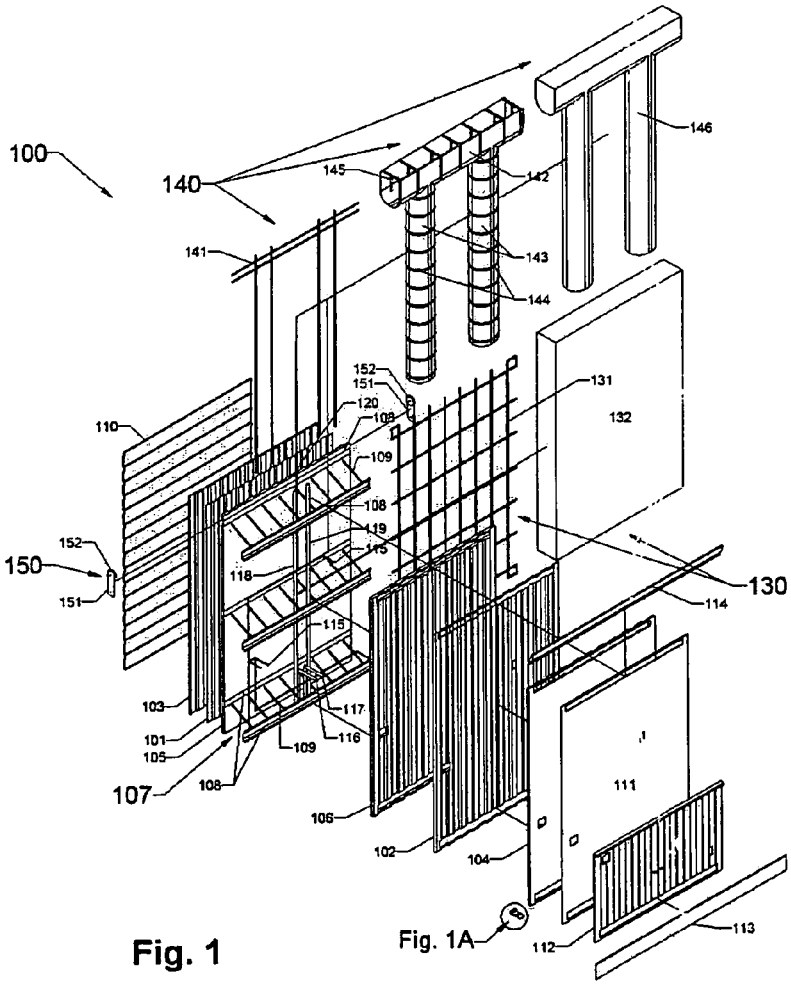
FIG. 1 is an exploded view of a wall section in accordance with the invention.
Figure 1A:
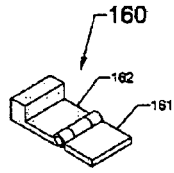
Figure 2:
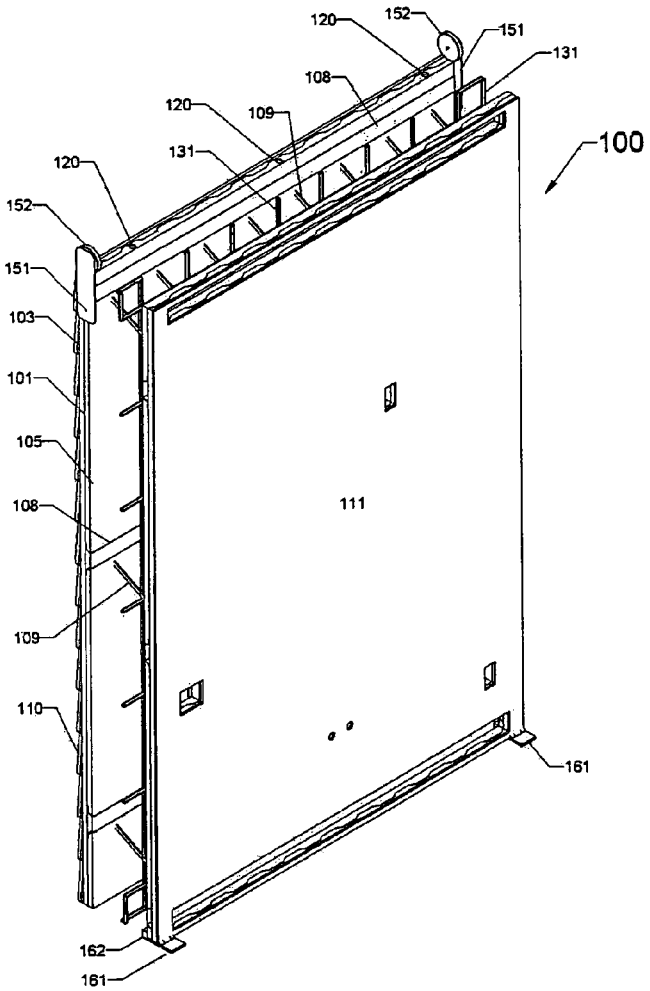
FIG. 2 is a view of the wall section of FIG. 1 assembled, but with interior finish removed.

Referring to FIG. 1, an exemplary section 100 in accordance with the invention is shown. Section 100 is a wall panel. Wall panel 100 has two planar structural members 101, 102, which define inner and outer structural cores or members, which define opposing form surfaces of adjustable separation from one another. Planar structural members 101, 102 have additional layers thereon in this embodiment. Planar layers of insulation 103, 104 are applied on either side of structural members 101, 102.

The adjustable separation between structural members 101, 102 may be achieved using any suitable mechanism. Means for providing adjustable separation may include rigid separators, such as bars, rotatably attached to structure members 101 102, or rods of fixed orientation but adjustable in length, such as a telescoping structure, or made up of multiple sections hingedly attached to one another.

In the depicted embodiment, grids 107 are the means for providing adjustable separation. Grids 107 have opposing longitudinal members 108, which are rigidly attached to structural members 101, 102. Transverse members 109 are rods rotatably attached at each end to longitudinal members 108. Transverse members 109 may be described as rotatably or hingedly attached at each end to structural members 101, 102.

Structural members 101, 102, may be of any material suitable in structural strength and weight in a generally planar form. As can be seen, structural members 101, 102 may have a ribbed or undulating configuration to increase structural strength. Materials may include sheet metal, a suitable plastic, or a composite. The members may also be of multiple layers built up of one or more materials.

Utility lines may also be provided within panel 100. Utility lines may include electrical wiring 115, water supply pipes 116, 117, wastewater pipes, fiber optic and wire cables for local computer networks, cable television and the like.

Finish features, such as exterior sheathing 110, and interior finish features, such as wallboard 111, may be applied on structural members 101, 102. Interior finish features illustrated in FIG. 1 include wainscoting 112, baseboard 113, and crown molding 114. Exterior and interior finish features may be attached prior to shipping of the wall section 100, or may be added after assembly. The interior and exterior finish features shown here are exemplary features, appropriate especially, though not exclusively, for residential homes, apartment and condominium buildings, and commercial buildings such as hotels.

Figure 3:
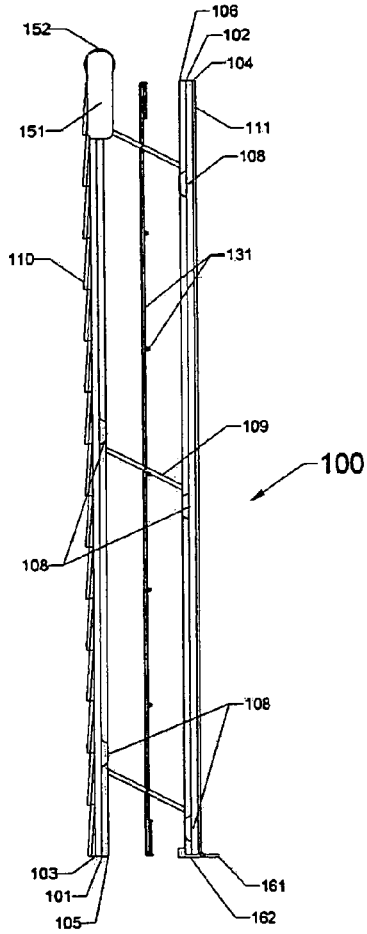
FIG. 3 is side plan view of the wall section of FIG. 2.
Figure 4:
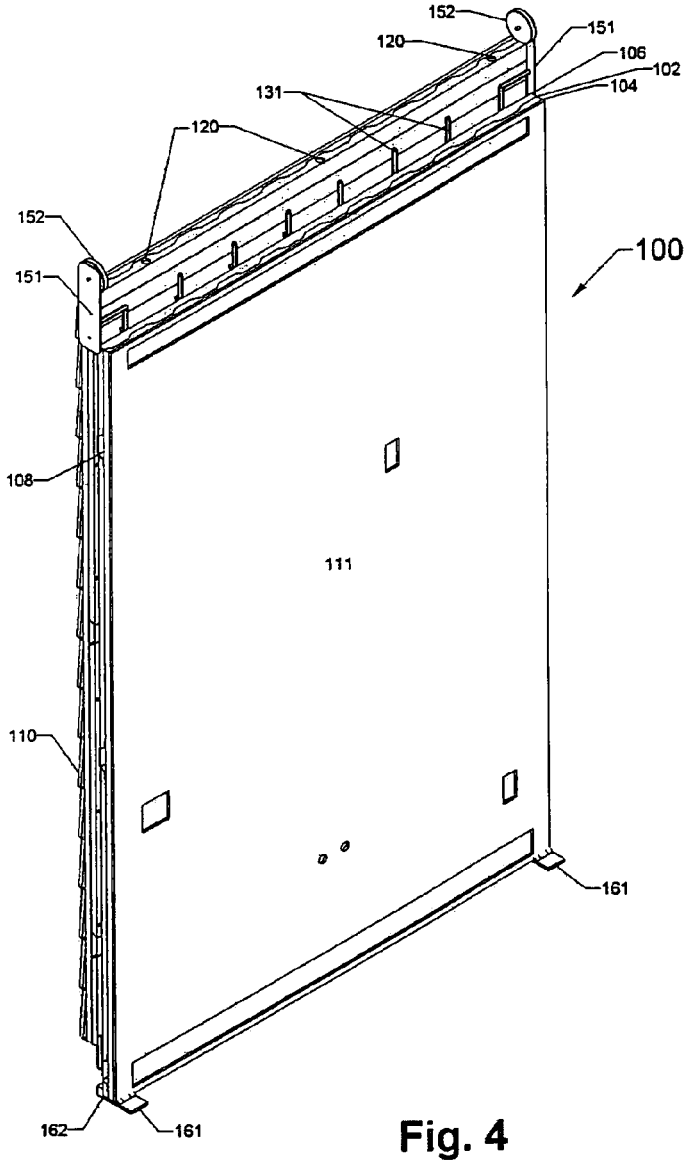
FIG. 4 is an isometric view of the wall section of FIG. 1 in a closed position.
Figure 5:
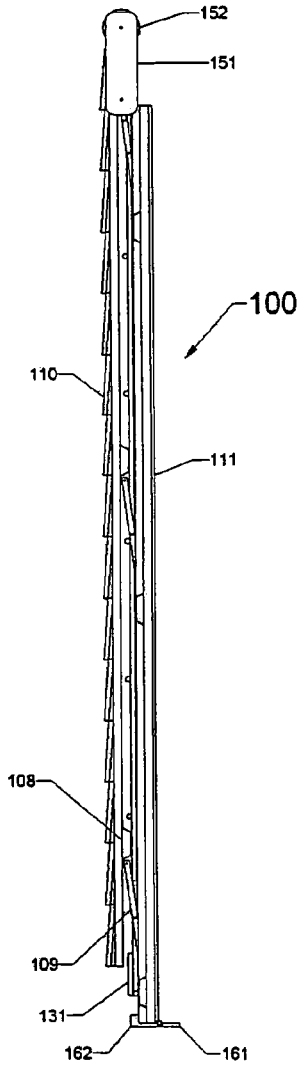
FIG. 5 is a side plan view of the wall section of FIG. 4.
Figure 6:
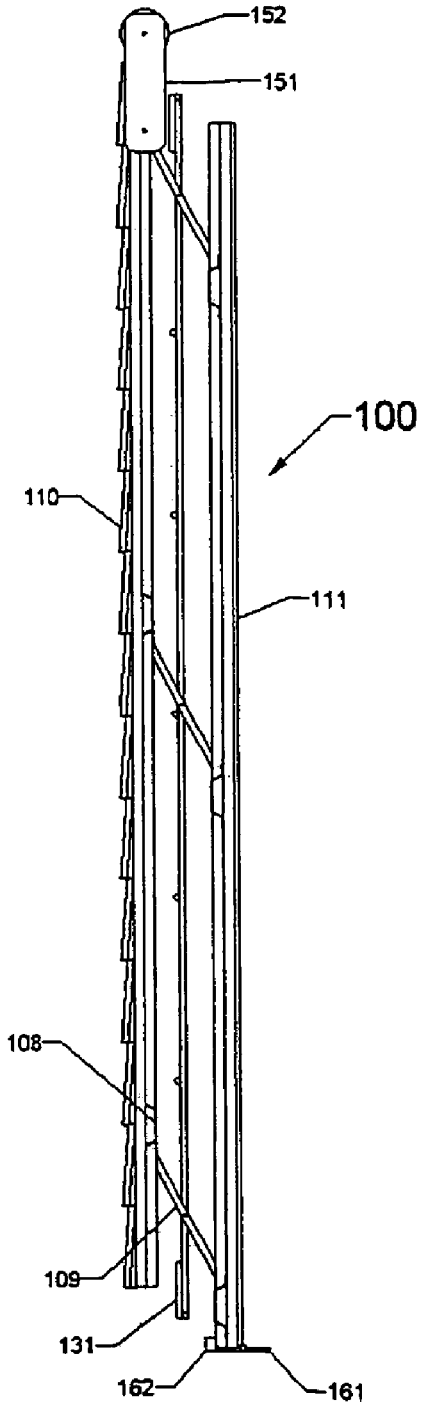
FIG. 6 is a side plan view of the wall section in partially open configuration.

Additional components to provide strength for the concrete or other flowing and setting material may be provided. An example of such strength-providing components is rebar in various shapes. By way of example, rebar 131 is shown. Rebar 131 is shown in the form of a grid, although this form is merely exemplary. Rebar may be supported on transverse members 109, so that the rebar is rotatable, as best seen in FIG. 3.

Examples of the form of the concrete are shown at 132 and 146. A solid wall 132 results from filling the entire interior with concrete. A header with two vertical legs is obtained by providing appropriately shaped forms within the wall section 100.

Figure 7:
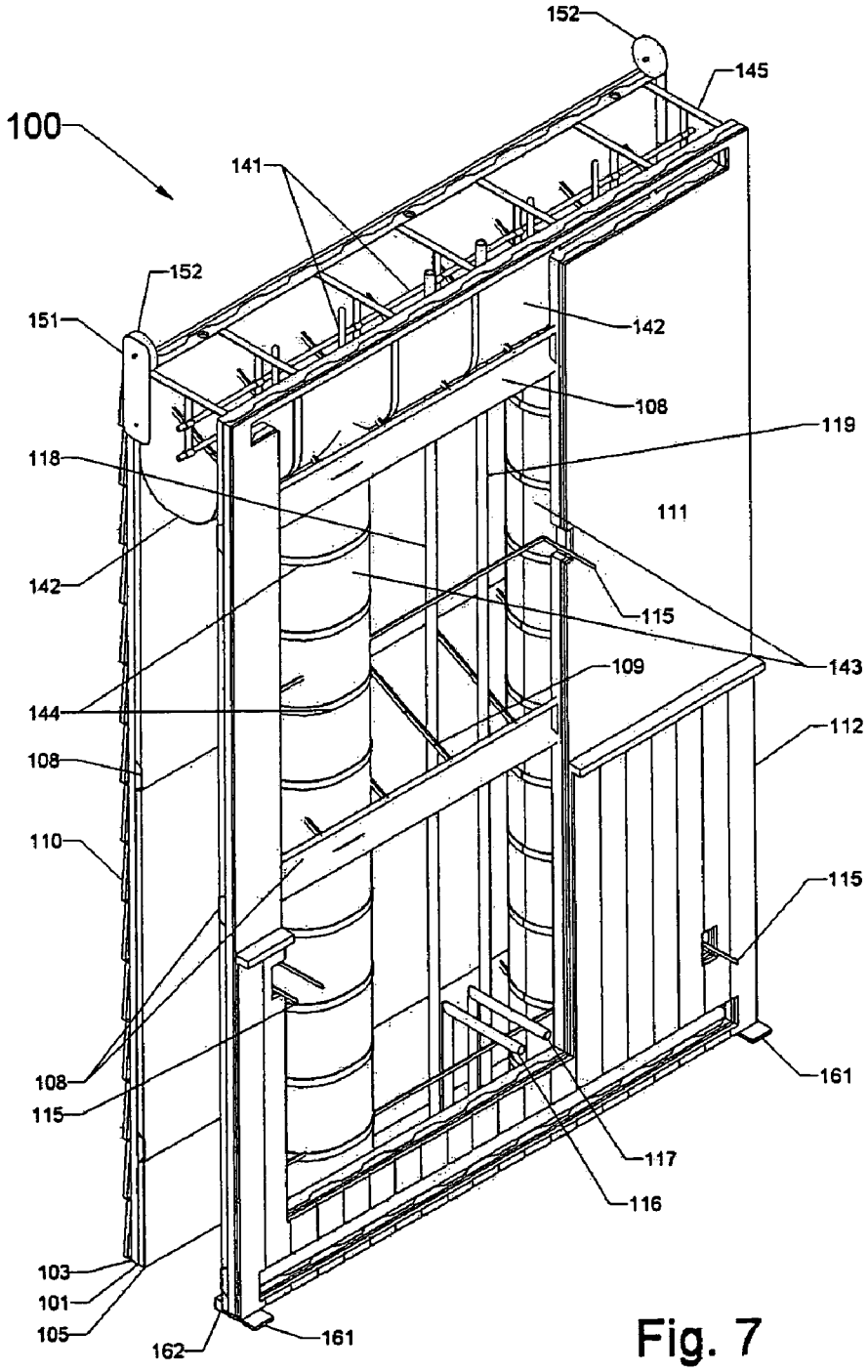
FIG. 7 is an isometric view of wall section of FIG. 1, fully assembled.

Referring now to FIG. 7, there is shown the panel 100 in partial cutaway. Panel 100 is adapted for pouring of concrete to form a header and two posts. The header is to be formed using fabric form portion 142 and rebar 141 interior to the form defined by fabric form portion 142. Fabric form portion 142 defines a channel having a generally U-shaped or semi-cylindrical bottom, vertical planar sides and an open top. Fabric form portion 142 may be made of any suitable natural or synthetic fabric having sufficient strength. Posts are formed by fabric form portions 143, which are in the form of hollow vertical cylinders intersecting at their tops with the bottom of fabric form portion 142. Rebar is provided in this example, so as to provide reinforced concrete posts.

Figures 7A, 7B, 7C, 7D, 7E:
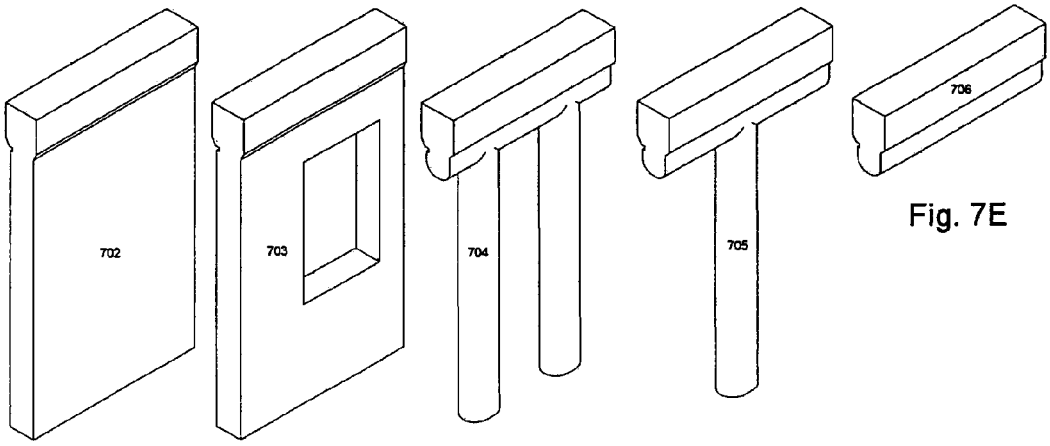
FIG. 7A–7E are isometric views showing a variety of structural cores within a completed wall section

Referring now to FIGS. 7A to 7E, there are illustrated selected shapes that the concrete structural portions of wall section 100 may take. In FIG. 7A, the concrete portion 702 is a solid wall extending from the header the entire height and width of wall section 100. FIG. 7B is similar to FIG. 7A, except that an opening has been formed in the solid wall. The illustrated opening is rectangular and positioned appropriately for a window. Techniques to cause flowing concrete to form in this manner are well known, and include creating a form of wood to prevent the concrete from flowing into the volume of the window. Fabric may also be employed in a form in connection with the formation of openings. Referring to FIG. 7C, there is shown a shape of concrete having two supporting vertical posts. The concrete is in the shape obtained using the fabric shown in FIG. 7. FIG. 7D is an alternative, in which a single supporting vertical post intersects the lower portion of the header. FIG. 7E illustrates a wall section in which concrete forms only a header 706.

Figure 8:
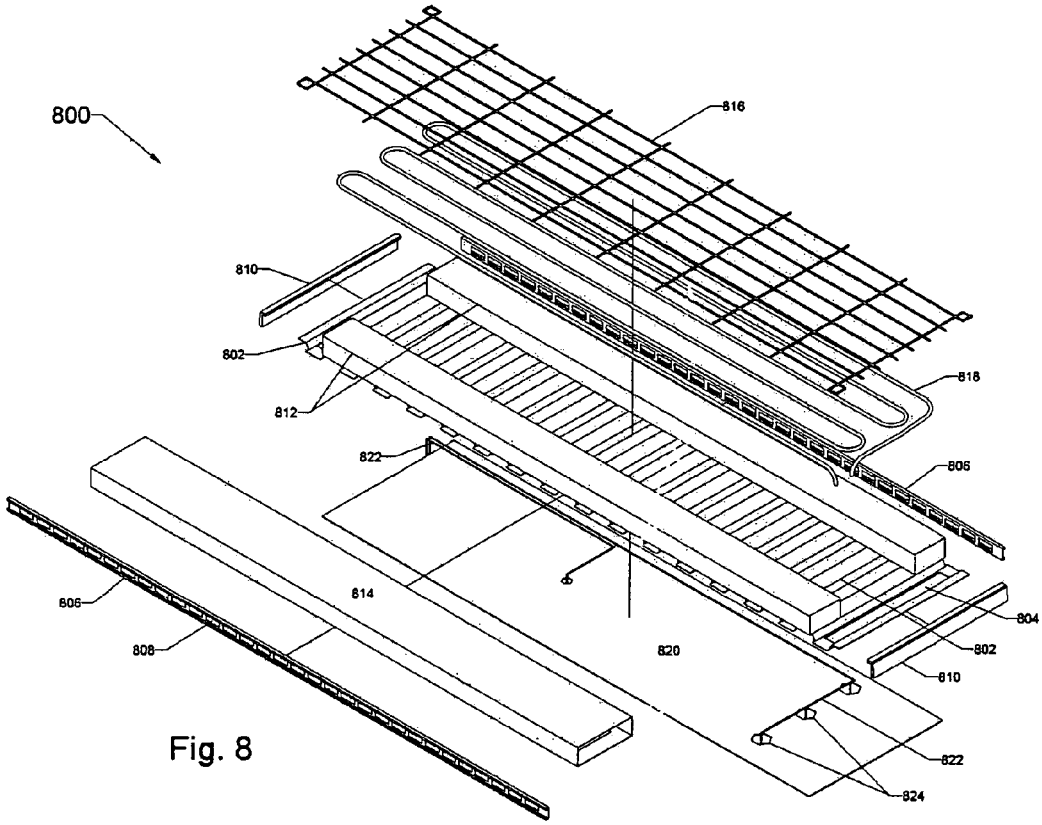
FIG. 8 is an exploded view of a floor/ceiling section in accordance with the invention.

Referring now to FIG. 8, a floor ceiling panel 800 of the invention will be described. Floor/ceiling panel 800 has components defining a form for poured concrete. The components may include optional air bladders, sidewalls of which constitute walls of the form. Floor bottom form 802 is overall planar and rectangular, with transverse troughs. The rectangular shape of floor bottom form 802 may be changed as appropriate for various structure designs. At each end of floor bottom form 802 an opening 804 is provided as a means of locking a wall section 100 in place in an assembled structure. Opening 804 may also serve as the opening through which concrete may be poured into the wall sections and join the walls to the poured floor structure. Along each side of floor bottom form 802 there is provided a sidewall 806. Sidewall 806 may be provided with slots 808, to provide for lifting of floor/ceiling panel assembly 800. If sidewalls 806 are used as sides of a concrete form, the slots 808 would not be provided. End walls 810 serve as end walls for the concrete form and are attached to floor bottom form 802 at each end thereof. Air bladders 812, shown in inflated form for ease of illustration, are provided to serve as walls of the concrete form, and to lift up components to a proper orientation. During shipping, air bladders 812 are deflated. Prior to pouring of concrete, air bladders 812 are inflated. HVAC duct 814 is shown. HVAC duct 814 is preferably expandable, so that it will occupy a small volume during shipping. The HVAC duct may be positioned intermediate air bladders 812, with a separation from each air bladder 812, to define two channels into which concrete will flow will poured to define beams. Reinforcing members, such as rebar grid 816, may be provided. Rebar grid 816 is an exemplary reinforcing member, and may be positioned over and between air bladders 812 and HVAC duct 814.

Additional non-structural features may be included in floor/ceiling panel 800. In the illustrated example, radiant heating coils, ceiling drywall 820, and electrical wiring 822 are shown. Radiant heating coils 818 may be provided with modular attachments to a suitable source of power. Ceiling drywall 820 is provided with openings 824 for electrical wiring 822. Electrical wiring 822 may be provided for lighting, smoke detectors, communications, and other appropriate uses as desired.

Figures 9, 9A, 9B:
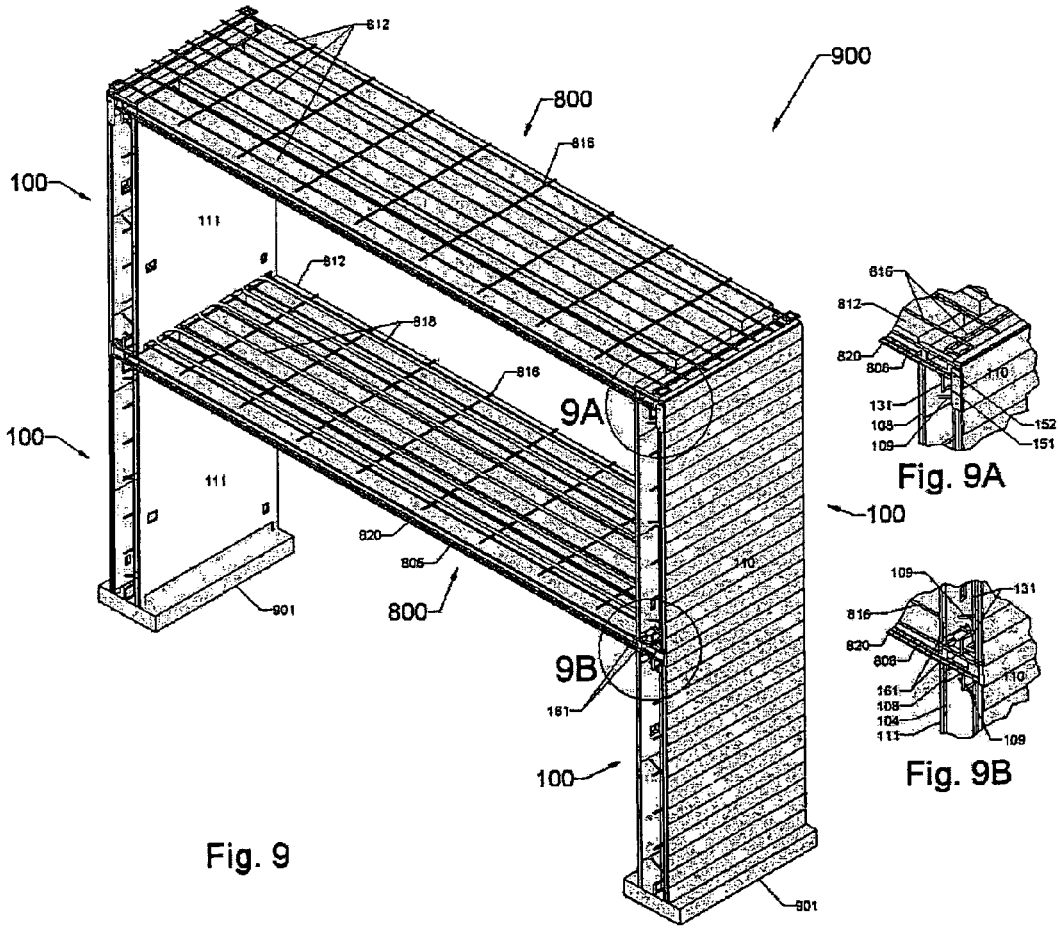
FIG. 9 is an isometric view of assembled components in accordance with the invention.
FIGS. 9A and 9B are enlarged views of portions of FIG. 9.

Referring now to FIG. 9, there is shown a structure portion made up of wall panel sections 100 and floor/ceiling panel sections 800 assembled in a structure portion 900 positioned on footings 901. Exemplary footings 901 are shown. Footings 901 may be in the form of reinforced concrete pads, or other suitably stable footings. A wall panel section 100 has been placed on each footing 901. Each wall panel section 100 is vertical and in its assembled position, i.e., with a space defined between the respective planar portions. Each floor ceiling panel 800 is shown in its assembled position, with air bladders 812 inflated, thereby lifting up other components, such as rebar grid 806, to their fully assembled position. Referring to FIG. 9A, it can be seen that arm 151 on the wall section 100 is in its upright position; roller 152 is at the end of the track defined in sidewall 806. Referring to FIG. 9B, it can be seen that a pivot is located at 161. A hinge or other suitable structure may be provided to permit pivoting of lower wall section 100 relative to the lower floor ceiling section 800.

Figure 10:
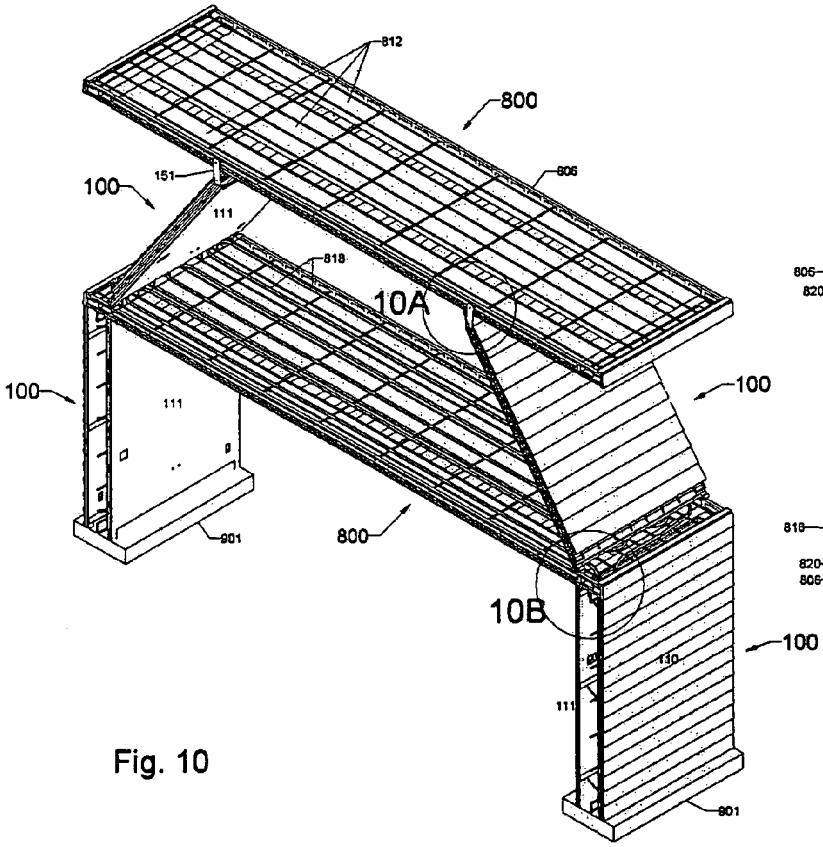
FIG. 10 is an isometric view of the components of FIG. 9, shown during a step of assembly.
Figure 10A:
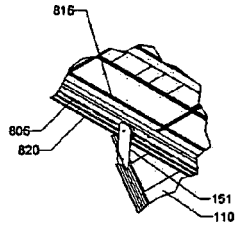
FIGS. 10A and 10B are enlarged views of portions of FIG. 10.
Figure 10B:
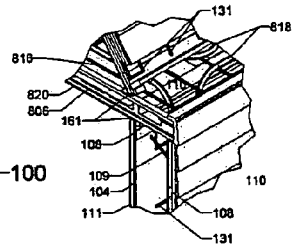

Referring now to FIG. 10, the structure portion 900 is shown in a partially folded position, between its shipping orientation and its assembled orientation. The upper pair of wall sections 100 have been moved to their shipping orientation, so that internal space within the wall sections has been minimized. The air bladders and HVAC duct in floor/ceiling sections 800 have been placed in their compact orientations. The upper pair of wall sections 100 have been rotated relative to the lower of floor/ceiling sections 800, and their upper ends have been permitted to slide and rotate with respect to the upper floor/ceiling section 800. Referring to FIG. 10A, the orientation of arm 151, generally at about a 45 degree angle, can be seen at an intermediate point in its progress along the track defined by form sidewall 806. Referring to FIG. 10B, it can be seen that wall section 100 has been rotated relative to floor/ceiling section 800.

Figure 11:
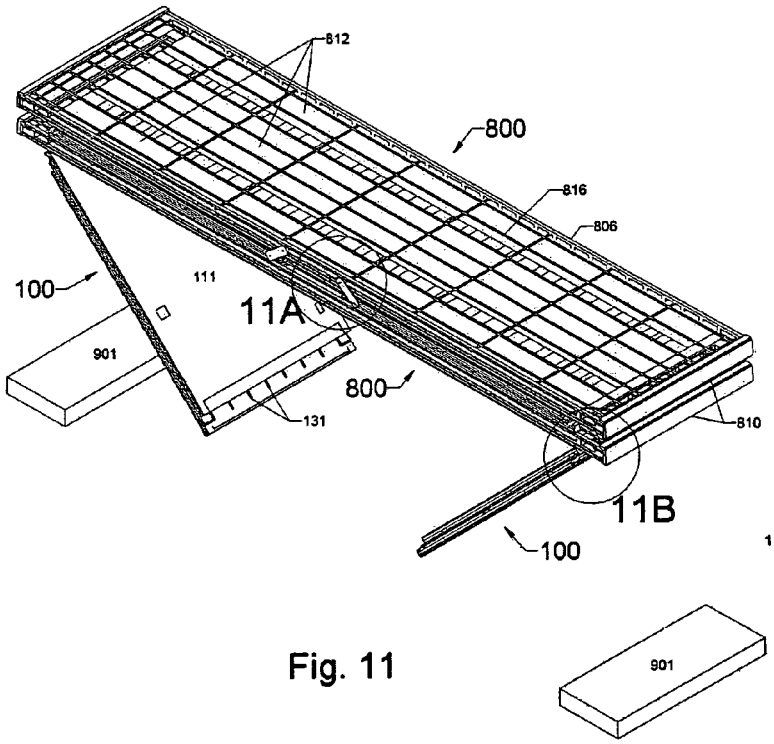
FIG. 11 is an isometric view of the components of FIG. 9, showing during another step of assembly.
Figure 11A:
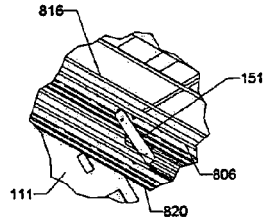
FIGS. 11A and 11B are enlarged views of portions of FIG. 11.
Figure 11B:
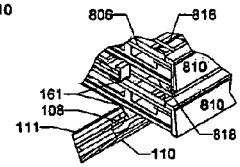

Referring now to FIG. 11, structure portion 900 is shown in an orientation further folded. The upper pair of side sections 100 have been moved to a horizontal orientation. The orientation of arm 151 can be seen in this orientation in FIG. 11A. Lower wall sections 100 have been moved to their shipping position, i.e. with the form walls moved together to minimize internal space, and have been partially rotated relative to floor/ceiling section 900. The relative orientation of lower wall section 100 and floor/ceiling section 900 can be seen in detail in FIG. 11B.

Figure 12:
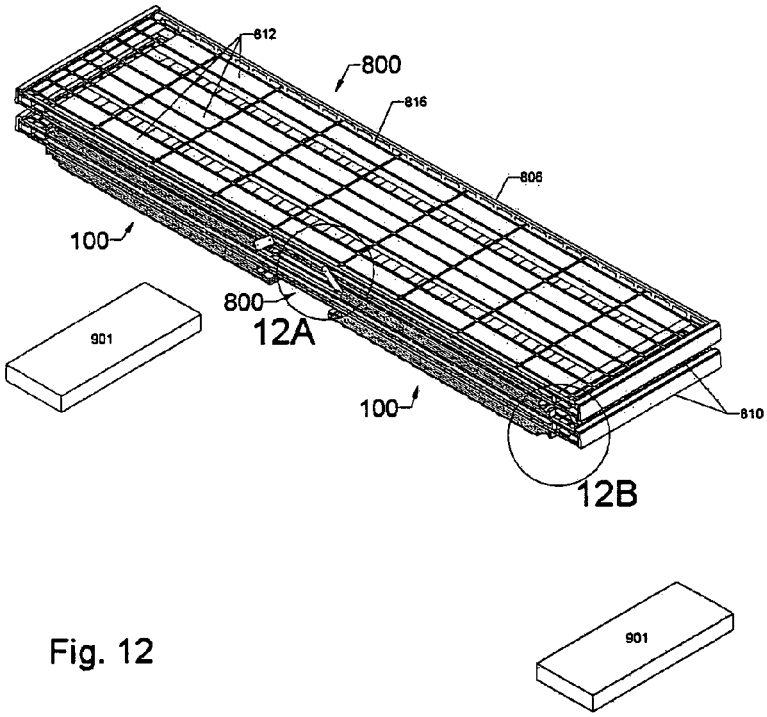
FIG. 12 is a view of the components of FIG. 9 in a shipping position.
Figure 12A:
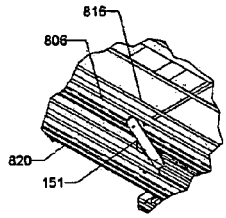
FIGS. 12A and 12B are enlarged views of portions of FIG. 12.
Figure 12B:
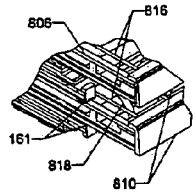

Referring now to FIG. 12, there is shown the structure section 900 in its shipping position. All of the wall sections have been rotated to be parallel with the floor/ceiling sections 800. All of the wall sections are in their compact, shipping, orientation. The floor/ceiling sections are also in their shipping orientation. Referring to FIG. 12A, it can be seen that arm 151 is parallel to floor/ceiling section 800 in this orientation. FIG. 12B shows the orientation of the ends of the wall sections 100 and floor/ceiling sections 800.

Figures 13, 13A, 13B:
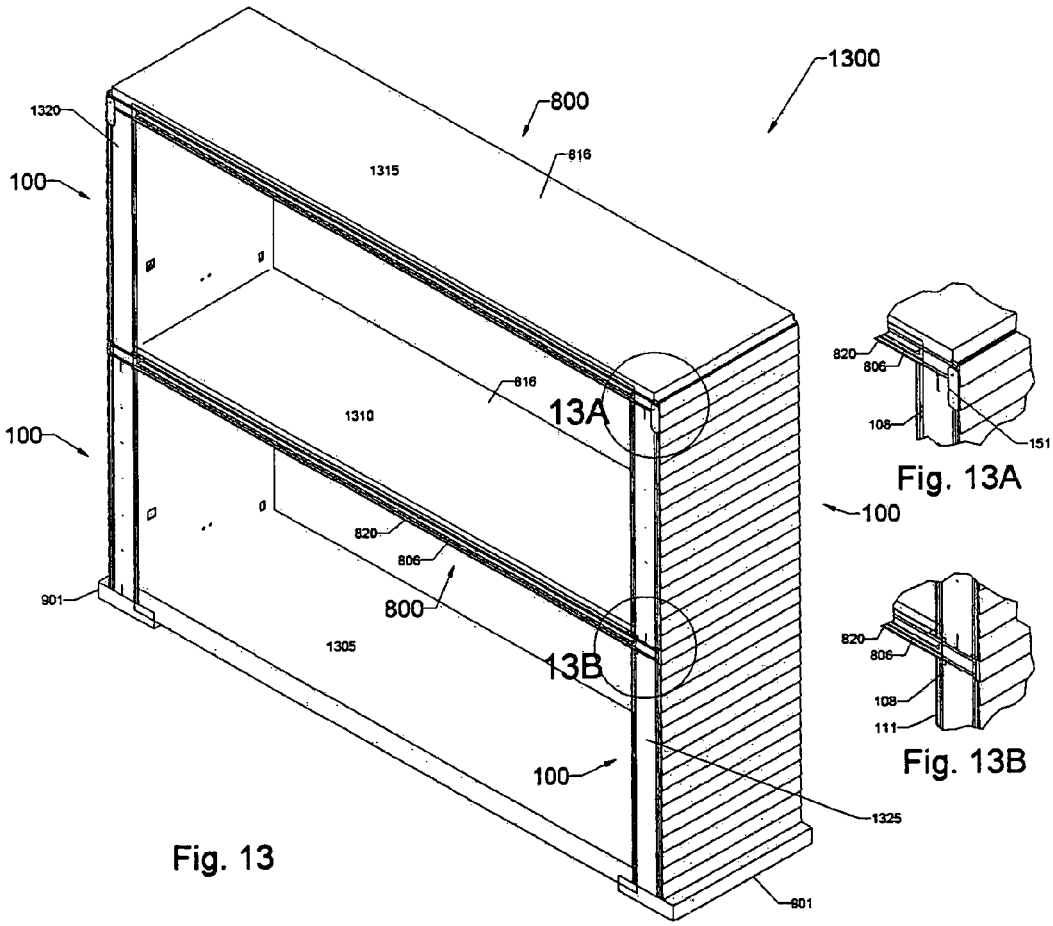
FIG. 13 is a view similar to FIG. 9, after concrete has been poured.
FIGS. 13A and 13B are enlarged views of portions of FIG. 13.

Referring to FIG. 13, the structure portion 900 is shown with poured concrete. In floor/ceiling sections 800, concrete 1305, 1310, 1315 forms two transverse concrete beams in the space defined between air bladders 812, form sidewalls 806 and form end walls 810. The concrete has also been poured on top of the air bladders 812 to form a structural floor system with the rebar grid 816 to a thickness desired for structural requirements Concrete 1320, 1325 can be seen filling the interior space of wall sections 100.

Figure 14:
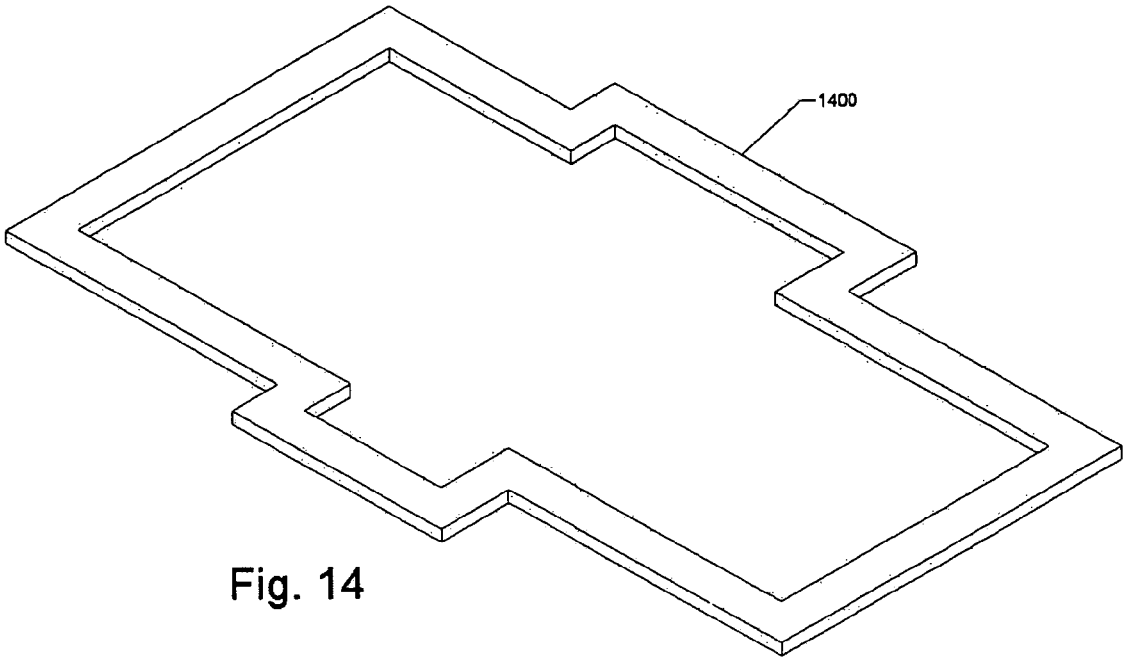
FIG. 14 is a somewhat schematic isometric view of a footing in accordance with the invention.
Figure 15:
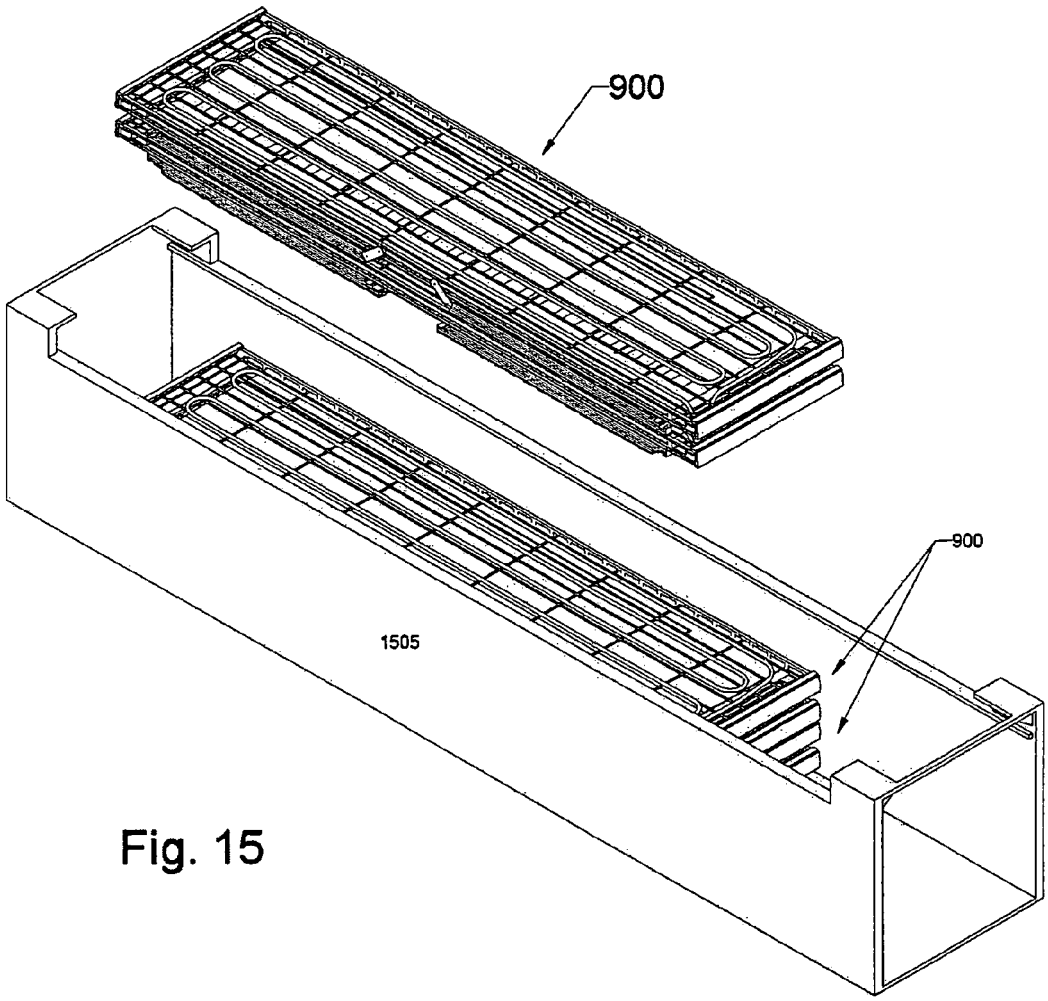
FIG. 15 is an isometric view showing components in relation to a shipping container.

The process of construction will now be explained. Construction is carried out typically on a foundation, such as exemplary foundation 1400 of FIG. 14 located on a site. The shape of the foundation may be selected as desired. Shipping container 1505 containing one or more structure sections 900 may be transported to the site. In FIG. 15, it can be seen that the roof of shipping container 1505 may be removed, and a crane or other device may remove structure sections 900. In FIG. 15, it may be seen that a generally conventional 40 foot shipping container may be packed with four structure sections 900 stacked on one another.

Figure 16:
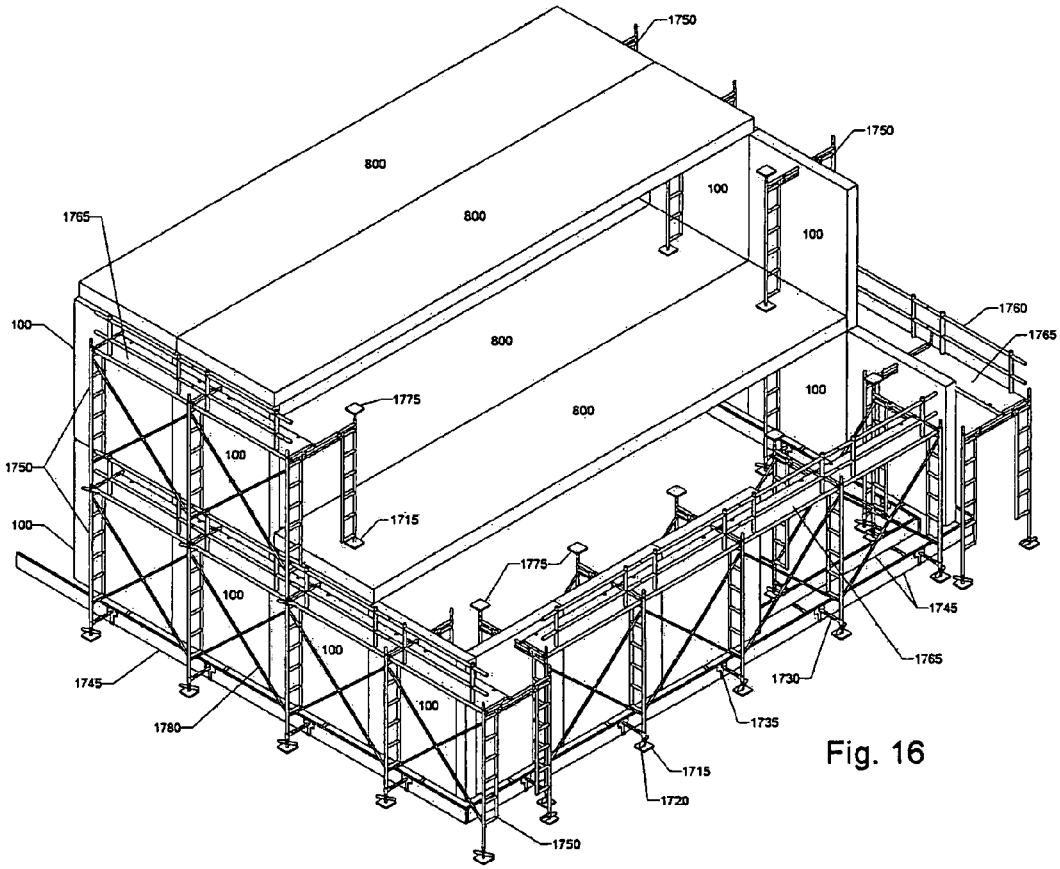
FIG. 16 is an illustration of a step in a method according to the invention.

Referring now to FIG. 16, a step in the process is illustrated. A two story structure is being assembled. Wall sections 100 and floor/ceiling sections 800 are shown schematically for ease of illustration. Scaffolding 1705 and footing assembly 1710 are integrally constructed in this embodiment to stabilize footing forms and wall sections in the process of assembly. These two functions may in principle be accomplished using separate structures. It will be appreciated that alternative structures may be employed to stabilize footing forms and wall sections. The base of the scaffold is preferably a scaffold leveling jack base 1715, as is commonly used, with a scaffold leveling jack adjustment screw 1720. Jack base 1715 and adjustment screw 1720 supports scaffolding uprights 1750. Scaffolding uprights 1750 have rods or other components for maintaining footing boards 1745 in proper orientation despite the pressure of poured concrete. A footing adjustment rod 1730, which is adjustable, determines the spacing between scaffolding upright 1750 and footing boards 1745. Footing board positioning bracket 1735 on rod 1730 may be used to maintain footing board 1745 in the proper orientation. Upper portions of scaffold vertical section 1750 support the top portions of wall sections 100, to keep wall sections 100 orientated vertical when concrete is poured. A hand railing 1760 and scaffold floor 1765 may be provided. Adjustable brackets 1775 are provided to support floor/ceiling sections 900. Adjustable brackets 1775 can reduce sagging of floor/ceiling sections under the weight of concrete until such time as the concrete is cured or adjusted to varied elevations to produce a pre-tensioning camber into the floor section 900 for greater strength to thickness ratio. Diagonal braces 1780 may be provided for additional strength and stability. In order to construct a second story, scaffolding can be placed on the first layer of floor/ceilings sections 900 once the concrete in floor/ceiling sections 900 has cured sufficiently. An alternative method is that a consumable adapter may be positioned to penetrate the floor section 900 and sit on top of the adjustable bracket 1775; a mating connector attached to the adapter above the poured section of the uncured concrete is positioned accept the $2^{nd}$ story scaffolding upright 1750. The consumable adapter can become an integral structural component or it can be removed or destroyed when the concrete is cured. This method will create an array of holes that are permanent to the floor, but they would easily be covered with the flooring and ceiling site finishes. The consumable adapter may be made of a rigid plastic or other suitable material.

Figure 17:
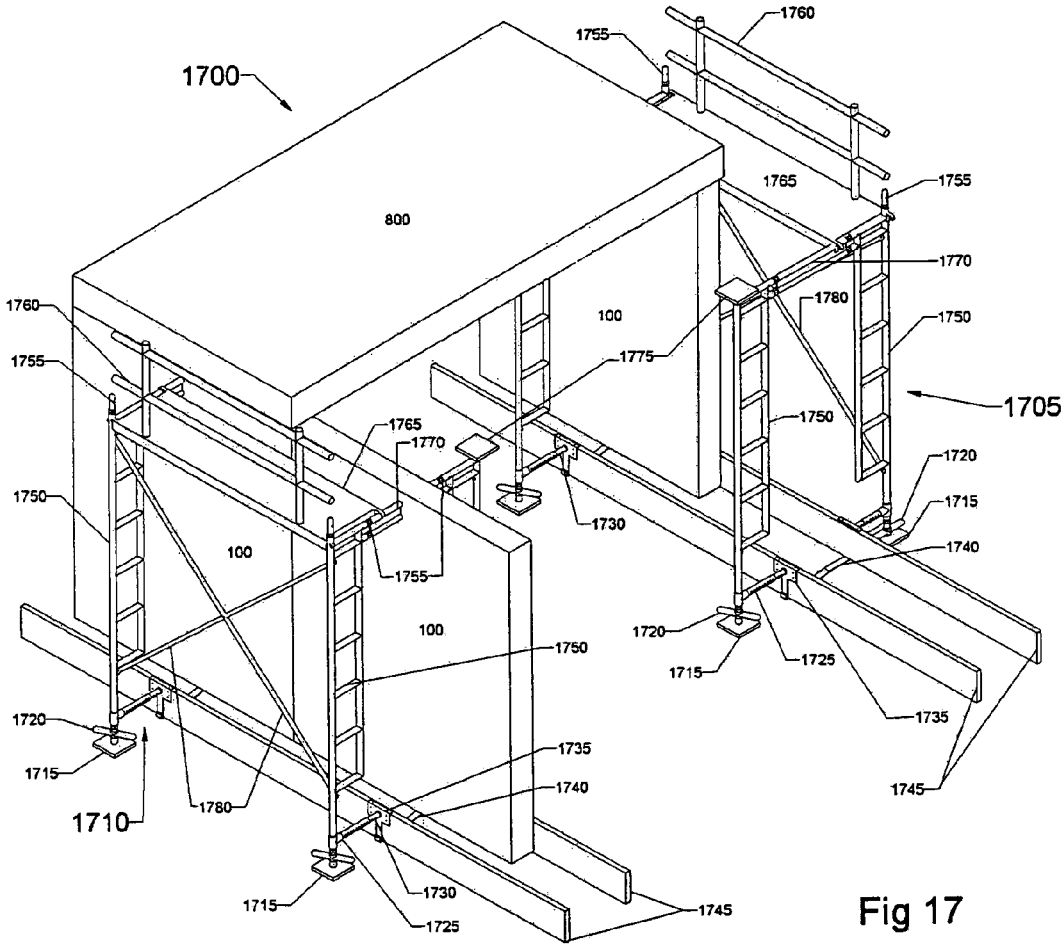
FIG. 17 is a detailed illustration of a step in a method according to the invention.
Figure 17A:
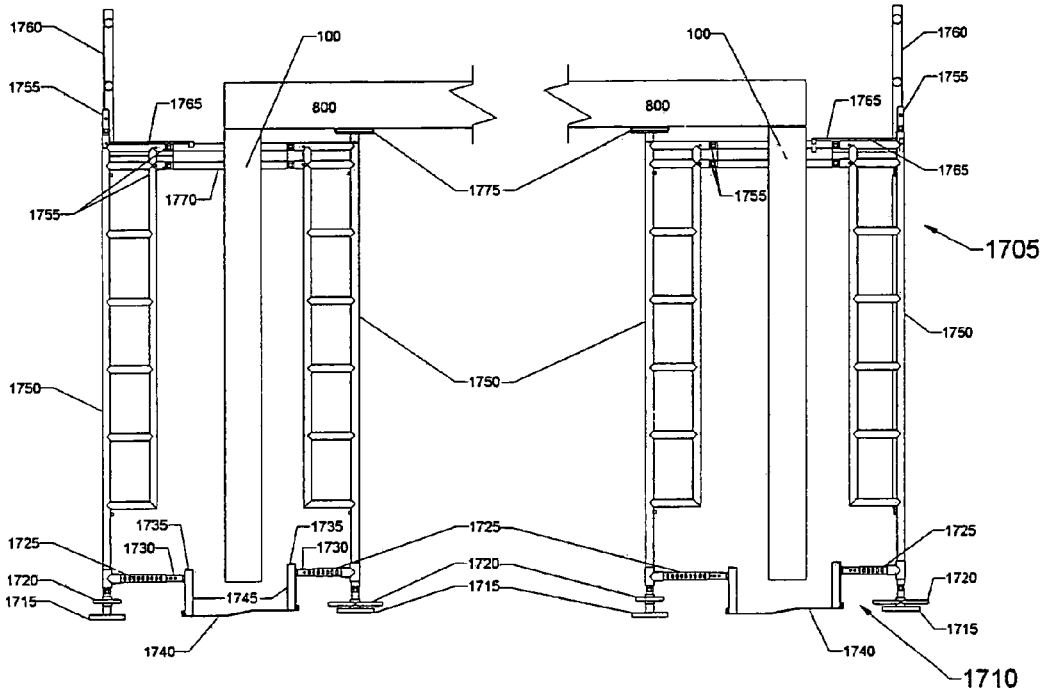
FIG. 17A is a side view of the step illustrated in FIG. 17.

Referring to FIG. 17, and FIG. 17A, various features may be seen. As best seen in FIG. 17A, the footing construction technique does not require leveling of the ground. Footing boards 1745 are supported by scaffoldings, with adjustable footing support bracket 1725 usable to adjust the effective length of footing adjustment rod 1730. Footing board positioning bracket 1735 is shown extending around the top of footing board 1745 in an L-shape. A lower footing pressure tie 1740 assists in preventing footing boards 1745 from separating as a result of the outward pressure of the poured concrete. The top of sections 100 are maintained stable using through wall removable sections 1770, which are connected to the scaffolding at connecting pins 1755. When pins 1755 are removed, removable sections 1770 are disconnected from the scaffolding.

Figure 18:
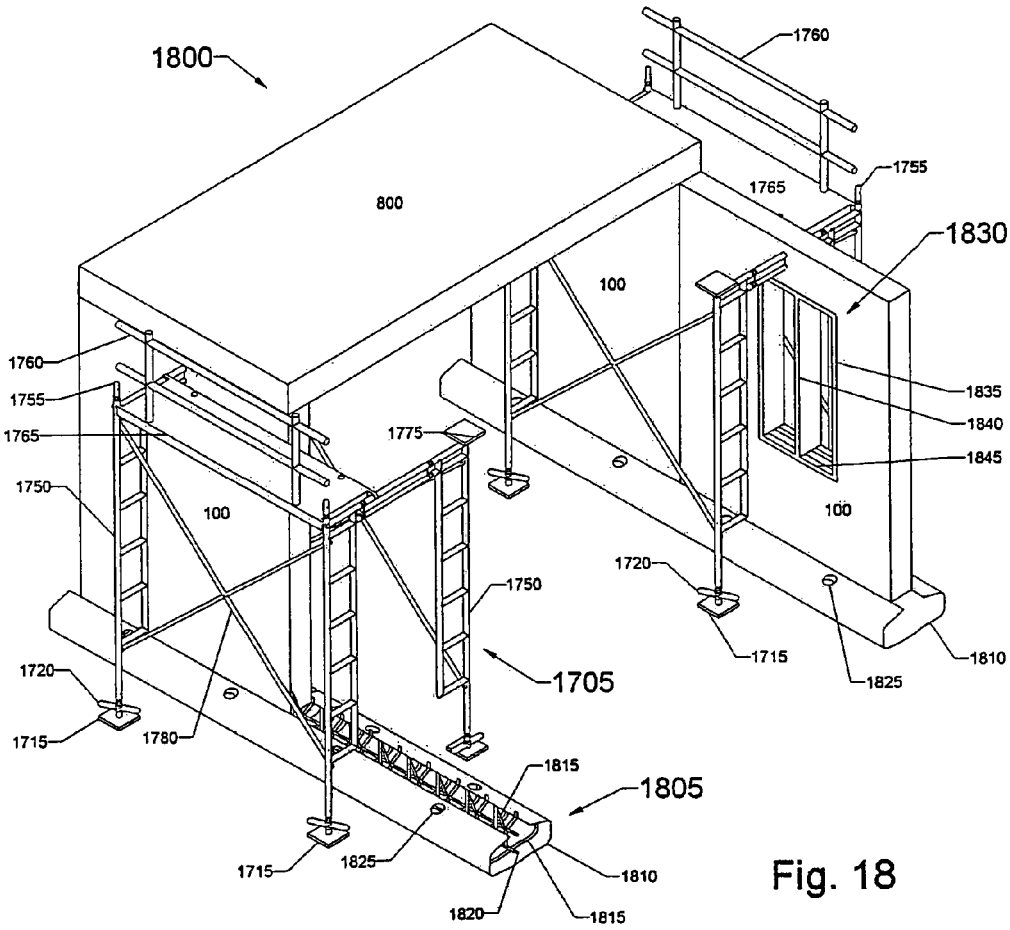
FIG. 18 is an illustration of a step in a method according to the invention.
Figure 19:
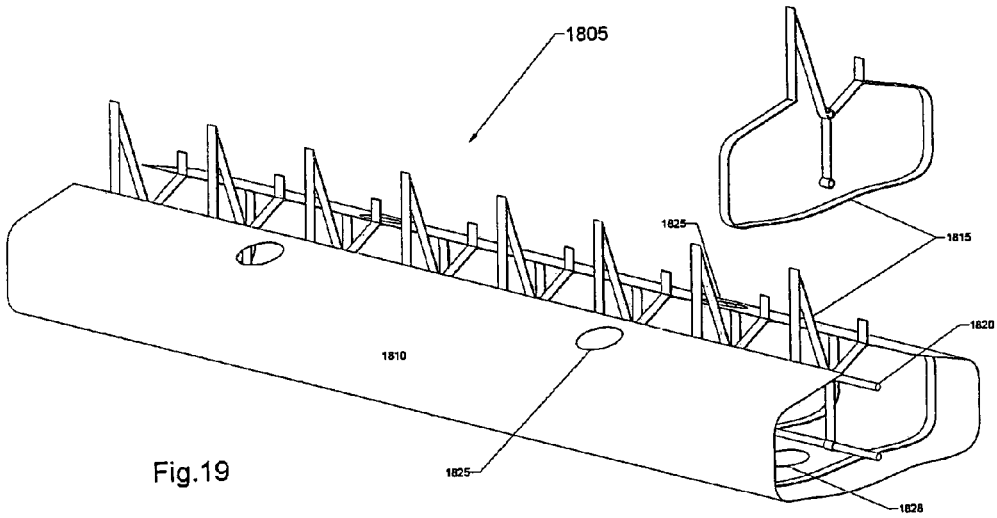
FIG. 19 is an illustration of a component used in a method according to the invention.

Referring to FIG. 18, the scaffolding 1705 of FIG. 17 is shown, but with a different system for constructing a footing. An integrated fabric footing assembly 1805, shown in additional detail in FIG. 19, is provided. Fabric 1810 is provided in an elongated ovoid shape with an open top. Stiffness is provided by fabric ribs 1815 with shape memory. Additional strength for the cured concrete is provided by footing rebar 1820 within the ovoid defined by fabric 1810. Fabric 1810 is provided with openings in its upper surface, namely footing fill inspection holes 1825, which permit ready checking of filling of fabric 1810 with concrete. Openings are provided in the bottom of fabric 1810 in the form of footing water drain holes 1828.

A window frame assembly 1830 is also illustrated in FIG. 18. Window frame 1835 is formed of planar members, which may be of wood, that define the boundaries of the window frame. A center support strut 1840 is provided to transfer some of the weight of concrete. Window sill 1845 has openings for inspection and for fill with concrete. It will be understood that window frame assembly 1830 is only exemplary. An alternative method of construction for window/door openings is the use of fabric, fastened to the wall structure, positioned to serve as a form. The fabric takes the place of the wood framing typical in construction.

Figure 20:
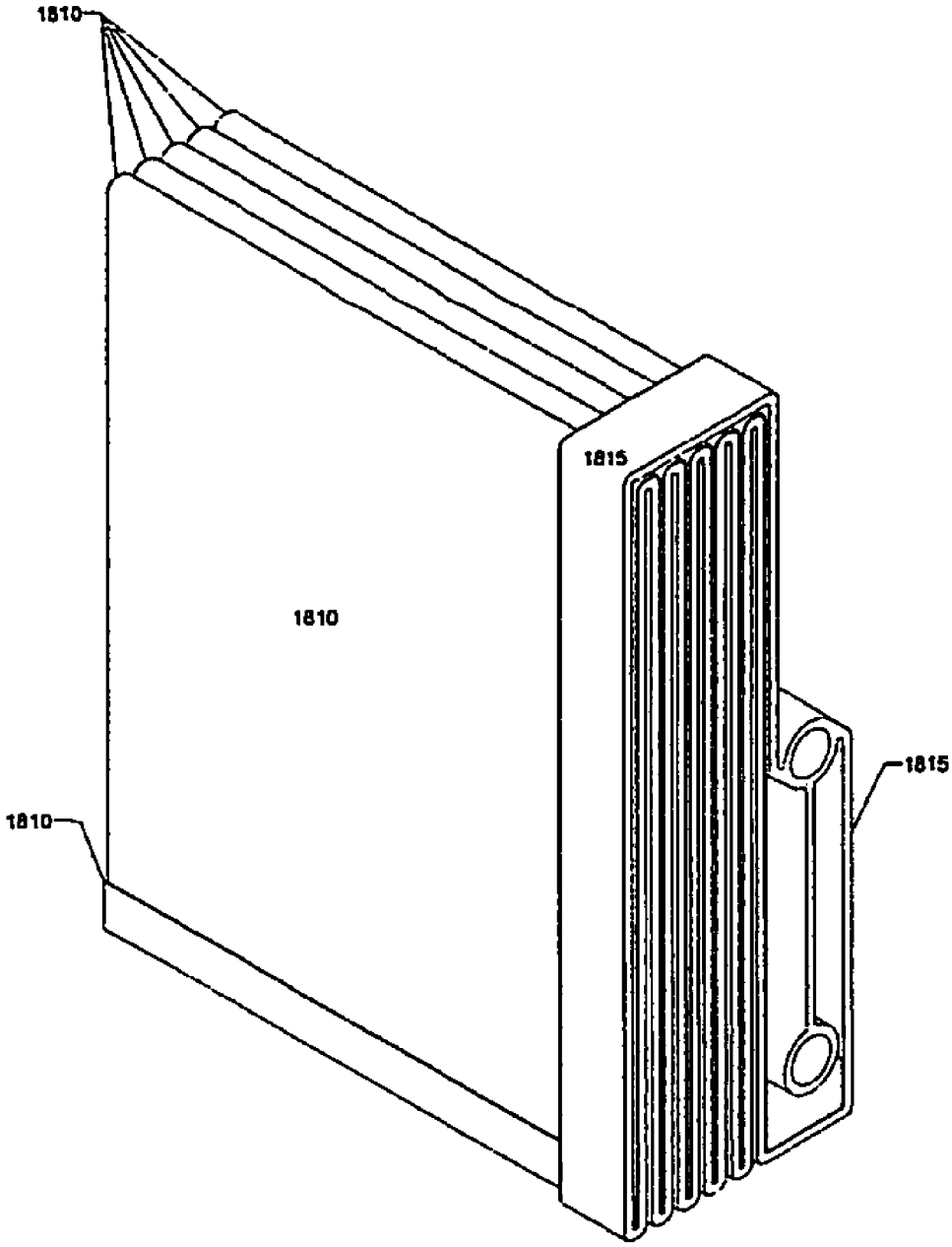
FIG. 20 is an isometric detail of a component used in a method according to the invention.

Referring to FIG. 20, a detail of fabric footing 1810 in a folded orientation for shipping is shown. Fabric 1810 has been folded compactly for shipping. Flexible rib 1815 is made of a material that has shape memory, so that it will attain the proper shape when unfolded. A variety of materials may be used for this purpose.

Figure 21:
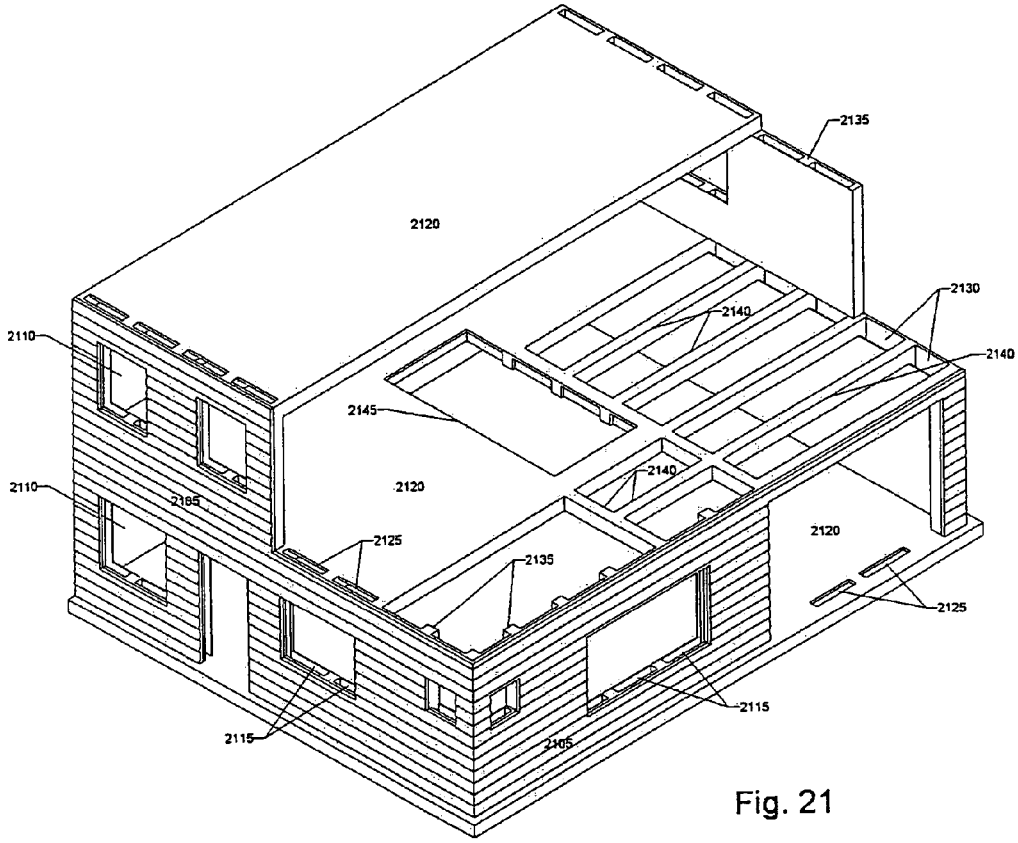
FIG. 21 is a view of a finished component in a method according to the invention.

Referring now to FIG. 21, the structure shown in FIG. 18 is shown finished, in partial cutaway, with poured concrete. A finished exterior wall 2105 has been defined, with optional features, including exterior finish in the form of siding in this example, and structural wall posts 2135. Optional window openings 2110 have been defined in exterior wall 2105. Wall air cavities 2130 may be provided for insulation. Wall air cavities may be filled with additional insulation, in the form of blown insulation or rigid foamed plastic, or in other forms. Wall air cavities may also be used for passive solar collection and distribution systems, as explained in more detail below. The air cavities can simply be useful to simplify future construction needs such as relocating a wall mounted light fixture. Air cavities 2115 have been defined within exterior wall 2105 around window openings 2110. First and second floors 2120 are shown. First floor 2120 has integral structural floor joists 2140 and a cut out 2145 for incorporation of a stairway. Floors 2120 may include air cavities 2125.

Figure 22:
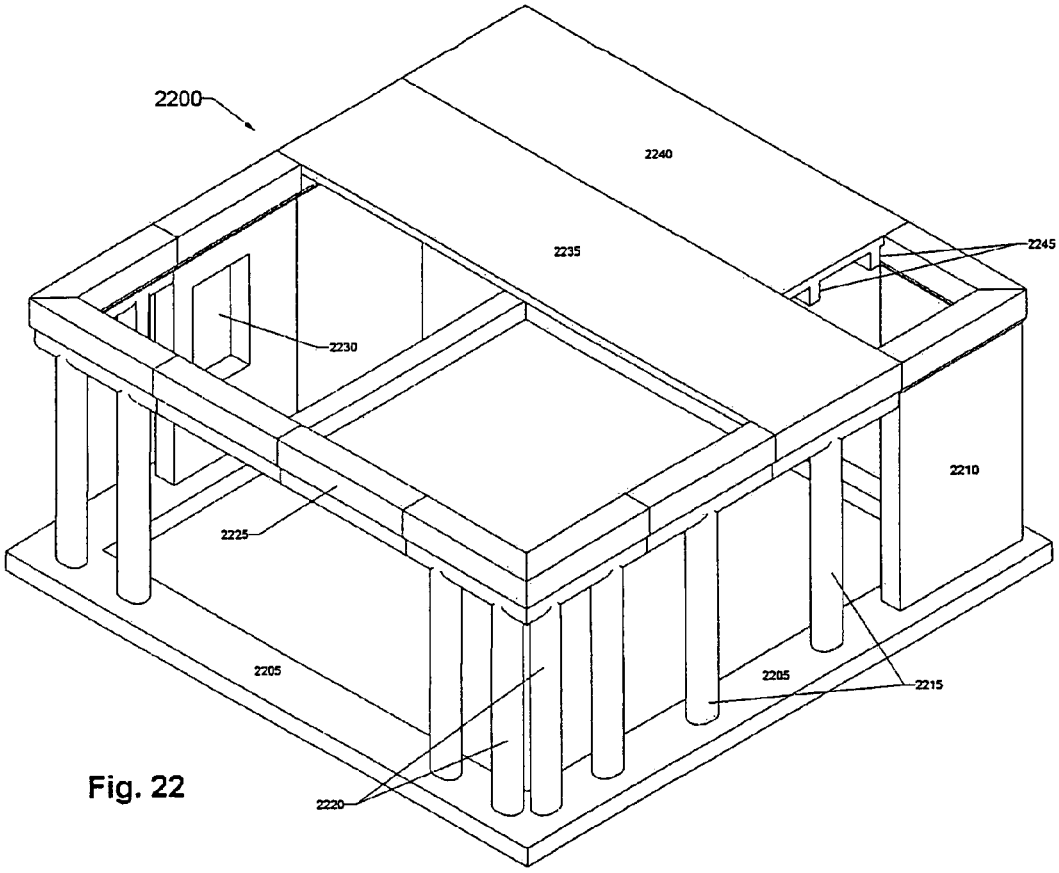
FIG. 22 is an isometric view illustrating a step in a method according to the invention.

In FIG. 22, concrete has been poured and set, to provide an exemplary partially-finished structure 2200, represented schematically. Structure 2200 is on footing 2205, which is shown as generally rectangular in cross-section for ease of illustration. Various types of walls are shown. These include flat, solid wall panel 2210, a panel having a header and a single post, at 2215, a panel having a header and a double post, at 2220, a panel having a header only, at 2225, and a panel with a window, at 2230. Structural floor panel 2240 is shown partially cutaway to reveal structural beams 2245. Structural floor panel 2235 is shown complete.

Figure 23:
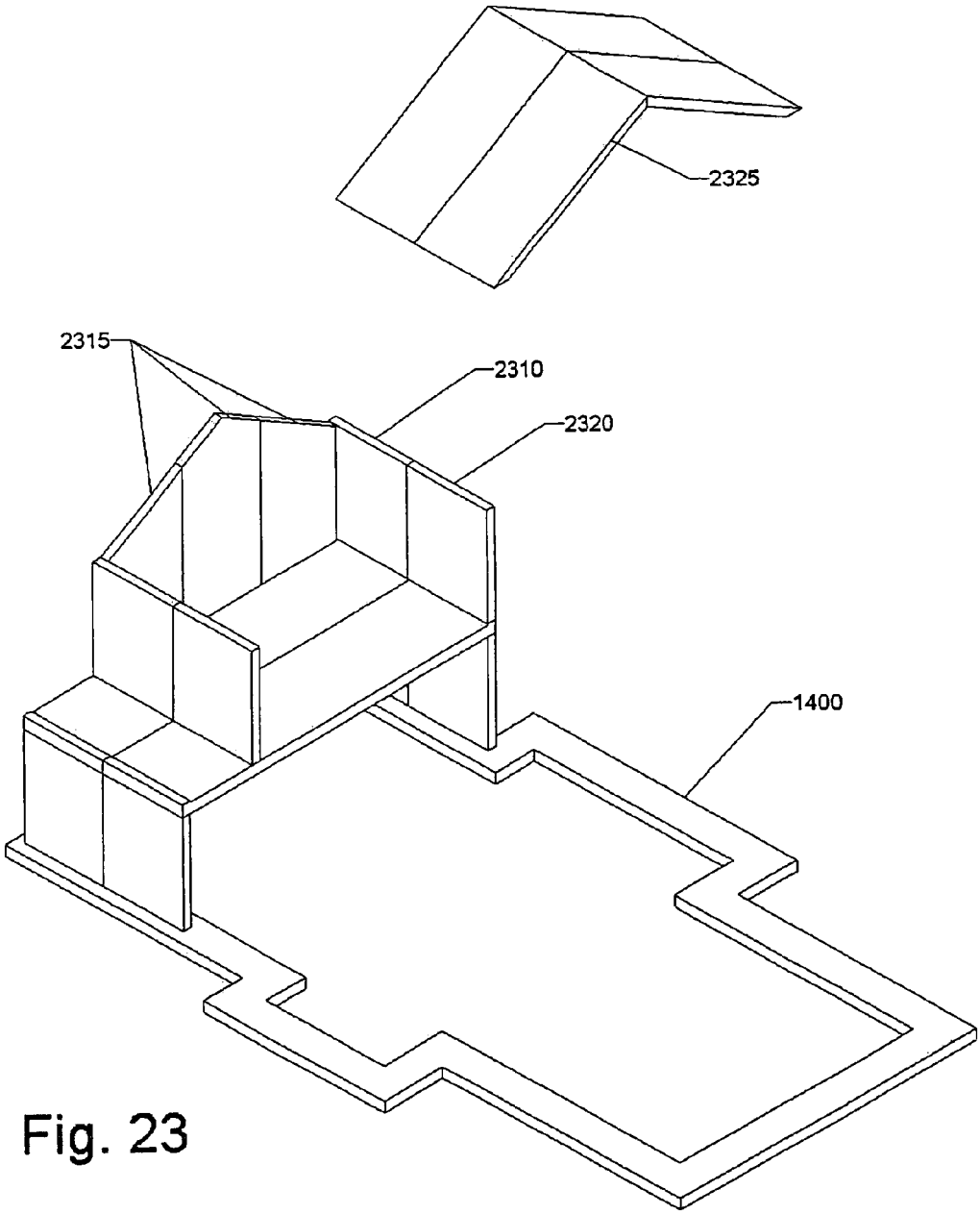
FIG. 23 is a somewhat schematic isometric view illustrating a step in a method according to the invention.
Figure 24:
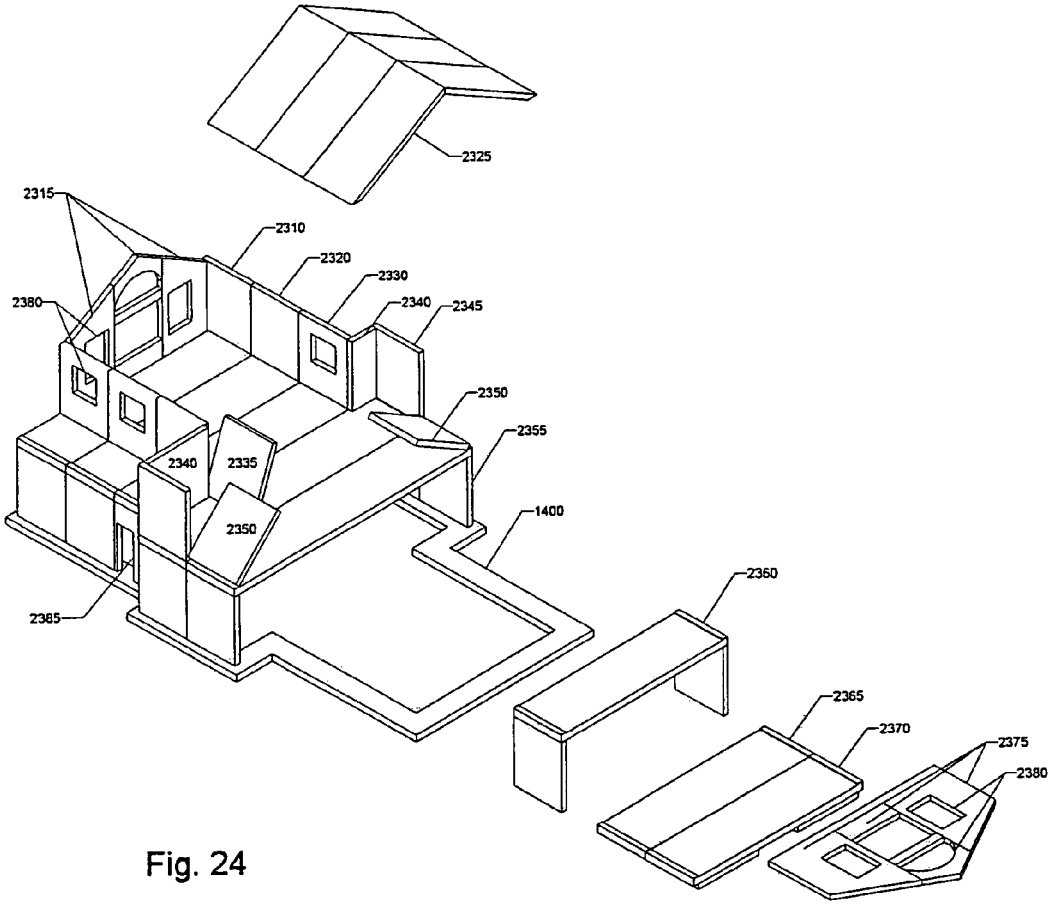
FIG. 24 is a somewhat schematic isometric view illustrating a step in a method according to the invention.

The construction of a residential building is illustrated with reference to FIGS. 23 and 24. In FIG. 23, two sections 2310, 2320 have been placed in position on foundation 1400. Sections 2310, 2320 may be generally similar to structural sections 900 discussed above. An end wall may be made up of three end wall sections 2315, which have window openings. Roof assembly 2325, which may be pre-manufactured and brought to the construction site, is also shown. In FIG. 24, finished segment 2330, which includes door 2385, has been added. End wall sections 2340 join wall sections between structure segments 2330, 2345. Interior wall section 2335, and wall sections 2350 are shown at an angle to their final positions. Segment 2360, to provide a one story garage, is shown. Segments 2365 and 2370 are shown still in their shipping orientation. End wall sections 2375 with window openings 2380 are shown prior to rotation into place.

The structure may take a wide variety of forms. The structure includes walls and a roof of a building suitable for use as a residence, storage, industrial, commercial, office and similar uses. The structure may be an open roof structure, such as a stadium. The completed structure refers to a structure which is suitable for use. In a typical structure, a structure is completed when an exterior surface is substantially complete, and when interior surfaces are completed.

Interior finish features include interior walls, of various materials, including drywall and wooden paneling, attached to the beams to define rooms. Interior wall surfaces may have finishes, such as paint or wallpaper. Interior wall surfaces may include openings for utilities, such as for electrical boxes for outlets and switches, openings for telephone, fiber optic and other types of communications wire and cable, and for water pipes for attachment of appliances.

Exterior finish surfaces will typically include a water-impermeable outer skin, of such materials as composites, aluminum, or treated or painted wood.

Wall section 100, which is exemplary, is for use in a structure, such as a residential building, such as a single family home, apartment building, motel or hotel. Wall section 100 is preferably assembled at a first location, which first location is distinct from the location of the placement of a structure of which wall section 100 is to be a part. For example wall section 100 may be intended for use in a structure to be placed on a foundation at a second location.

The first location may be a factory or other location for specialized assembly of structures and possibly other items. A variety of advantages may be obtained by use of factory assembly over assembly at a construction site. The factory may be located closer to sources of supply of inputs than the construction site. A factory offers better control over environmental conditions. Greater efficiencies in use of materials and in methods of fabrication and assembly of components may be obtained. The first location and second location may both be in the same country or economic area (e.g., the United States or the European Union). Shipment by ground transportation between the first and second location may be available. The first and second locations may be in different countries, but shipment by ground transportation, including truck and train, may be feasible. Truck transportation may include transport of trucks by ship for relatively short distances. The first and second locations may be on different continents, and wall section 100 may be transported by ship. Wall section 100 may be placed in a shipping container and shipped by one or more of water, rail and road.

External finish features may include any suitable weather resistant material, including aluminum panels, composite, wooden panels (clapboard), and other materials.

Optionally, cables and pipes may be incorporated in raceways. Electrical cables may include fixed sections and flexible end sections for adjustment and connection to electrical cables in adjacent wall panels. Similarly, water pipes may include rigid sections and flexible sections for attachment to pipes in adjacent sections. Pipes and wiring may be configured with flexible connectors, to connect to adjacent wall sections, and for final attachment to fixtures. Alternatively, pipes and wiring may be made of flexible materials.

Drywall 111 may be of conventional thickness and construction fixed to studs 104 in a conventional manner, such as by screws or nails. Drywall 111 is preferably not attached by removable fasteners. Drywall 111 may have a coating, such as a primer coat of conventional paint. Drywall 111 may be made of a single sheet of drywall, or may be made of several sheets positioned adjacent one another.

Depending on the needs of the particular application, wall section 100 may be the entire height of a story in a structure, or may be a fraction of the height. Multiple wall sections 100 may be joined by hinged joints to permit folding for transportation.

As an alternative to drywall, a ceiling may be of any material suitable for a ceiling surface of a structure.

Floor/ceiling sections may have utility components interior thereto. Such utility components may include cables, pipes, ducts and the like, and/or raceways for insertion of electrical and communications cabling, pipes and ducts, openings for electrical fixtures, openings for plumbing fixtures, raceways suitable for electrical cabling, communications cables, pipes and ducts. Floor/ceiling sections may have utility components, such as provisions for integrated utility functions, such as radiant floor heating.

The folded dimensions of structure segment 900 must be no greater than the dimensions available during transport. For example, if, as illustrated, four structure segments 900 are to be transported in a shipping container, the dimensions must be sufficiently small to permit insertion in the container. Typical shipping containers are 40 feet in length, and 7.5 feet in height and width (approximately). If structure segment 900 is to travel on a truck, the size is preferably sufficiently small that a standard roadgoing truck may be employed, without any need to designate the truck as carrying an oversize load. The maximum width of a load permitted without special oversize load permits varies, from about 8 feet, six inches, to about 10 feet or more.

Structure segment 900 may be of differing width depending on available transportation. For example, if transportation by road with oversize load designation is available, then, in the United States, the building segments may be significantly wider, such as up to 15 feet in width, and more than 15 feet in width, depending upon the route.

Structure segment 900 may be moved to an assembled position by a variety of techniques, including cables tied to floor/ceiling sections and lifted by a crane, a scissors lift, as explained below, a fork lift engaging lifting slots 808, a system of driven cables, and other techniques.

Any additional interior and exterior finish items may be attached at the first location. Such finish items may include trim and moldings, external features, such as decks and balconies, and internal features, such as cabinets and counters. Electrical outlets, switches and devices may be connected to wiring, and cables may be connected among sections. Other cables, pipes and fixtures may be connected. All of the foregoing connections are preferably fully reversible, making use of reversible electrical connectors for electrical connections, and other reversible connectors.

The structure may then be inspected for compliance with design specifications. Any errors in the manufacturing process that result in a failure of components to fit properly can be identified in such inspection and corrected. Replacement components can be obtained, or components altered for proper fit, or to correct other failures to comply with specifications. Inspections required to meet local building codes can be carried out. Code violations can be communicated by inspectors, and appropriate changes made to meet code can be made. If structures meet code, appropriate approvals or certificates can be issued at this time.

In addition to pouring of concrete, at the construction location, final finish work, including closing seams around connections and joints between building structures, and application of final surface treatments, such as painting, may be completed.

It will also be appreciated that the individual wall and floor/ceiling sections may be manufactured without provision for hinged connections. When the parts are assembled, they may be removably assembled together by reversible connections, such as various types of engineered locking devices, ties or screws. After testing, the connections are loosened, and the individual parts are packed for shipment. The parts may be packed in a container, similar to the discussion above. The parts may be loaded on suitable pallets or trailers, if desired. When the parts are delivered for final assembly, the parts are successively permanently attached to foundations and then to one another. The respective parts may be provided with features, such as mating protrusions and recesses, that will cause adjacent parts to be self-aligning. This variation still results in substantial cost savings upon assembly.

Figure 25:
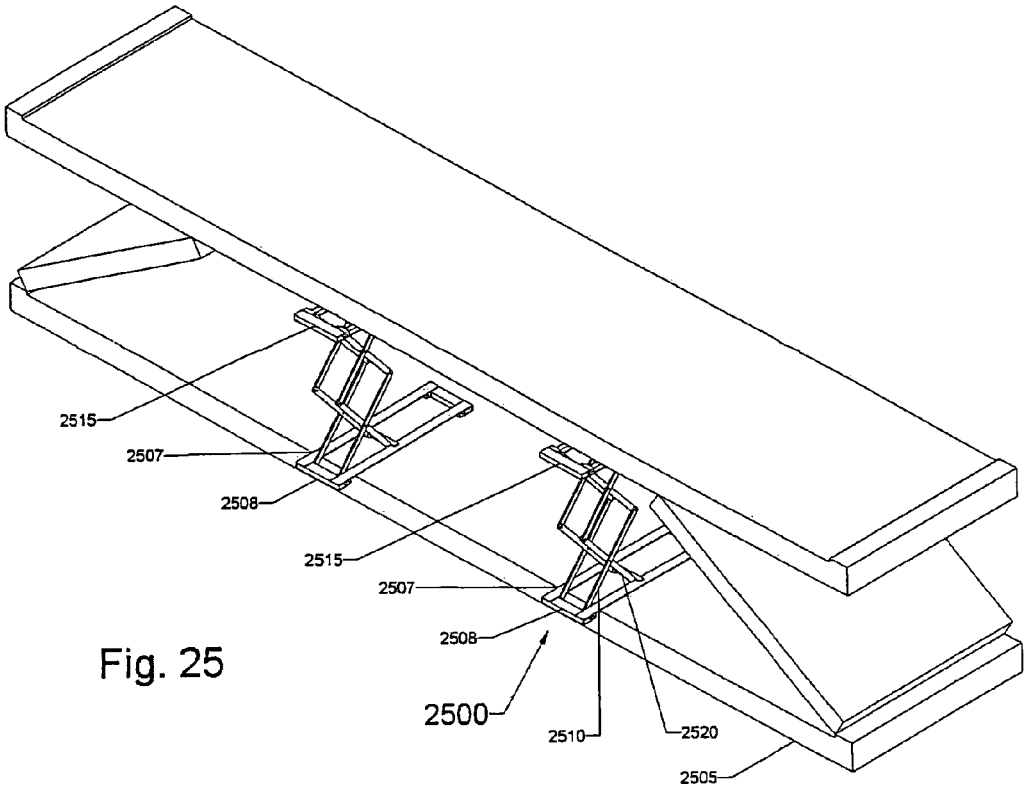
FIG. 25 is a somewhat schematic isometric view illustrating a step in a method according to the invention.

A variety of devices and methods may be employed for lifting and lowering components of the structure of the invention. In FIG. 25, a scissors lift device 2500 is shown. Two scissors lifts 2500 are illustrated partially lifting a ceiling section and attached end wall sections above a floor section. The illustrated application is merely an example, and the scissors lift may be employed to lift other structures. More or fewer scissors lifts may be employed as appropriate. Scissors lifts 2500 have a base 2505. Base 2505, in this example, is generally in the form of a rectangle of high strength bars. Longitudinal bars 2507 serve as rails for supporting movable uprights, and transverse bars 2508 support the load of the scissors lift and the load which it carries. However, it will be appreciated that other base designs may be employed. The upper support 2515 may be identical to and interchangeable with the base. Each scissors lift 2500 includes two uprights 2510, 2520. Each upright has upper and lower parts, rotatably attached at an intermediate point. Each part may be a pair of parallel rods of equal length. One upright may be rotatably attached at fixed points to upper and lower bases and the other rotatably and slidably attached to longitudinal bars 2507. Application of force to separate the extended transverse bars can be employed to increase the separation.

Figure 26:
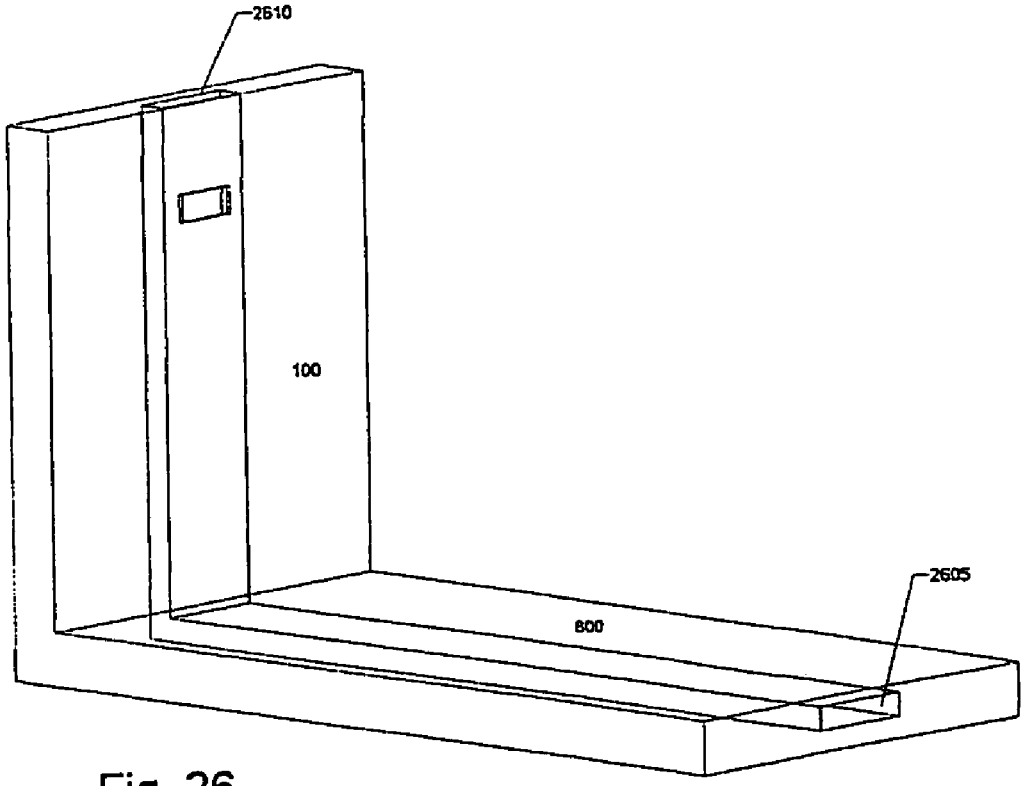
FIG. 26 is a somewhat schematic view of an article in according to the invention.
Figure 27:
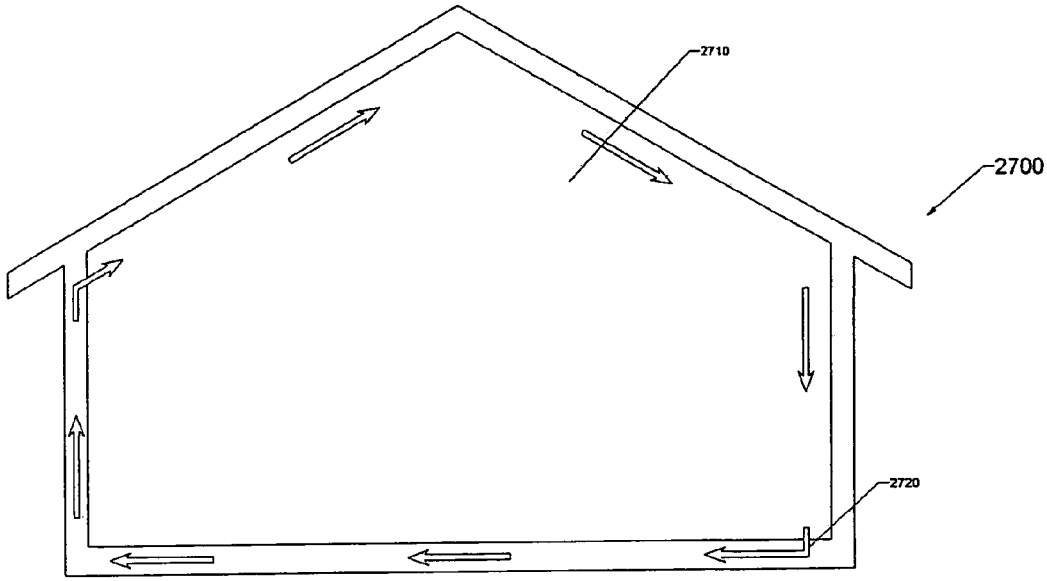
FIG. 27 is a schematic view illustrating use of an article of FIG. 26.

Referring to FIGS. 26, 27, a passive solar heating structure component will be described. In FIG. 26, a wall section 100 and a floor section 800 of a building are shown adapted for use in a passive solar heating environment. A continuous void or duct is shown in both the floor section and the wall section. In this embodiment, the continuous void or duct is made up of floor duct 2605 and wall duct 2610, which are in physical communication with one another. A void may be defined by an inflatable section or a void intermediate concrete posts. The wall section 800 preferably has a large mass of concrete or other material, and the duct is positioned so that a fluid, such as air, flowing through the duct will contact and be heated by the concrete mass, when the concrete mass is at an elevated temperature. A variety of configurations of routes of flow of materials may be employed. The wall section is positioned to receive a maximum amount of solar radiation. For example, in the Northern hemisphere, the wall section has a southern orientation.

In FIG. 27, an exemplary air flow is shown schematically in structure 2700. The arrows show the flow of air. Air flows from interior room(s) or interior space 2710 into the ducts at opening 2720. It will be appreciated that the design may be adapted for multiple interior rooms or partitioned spaces and for multiple intake openings. Air then flows through ducts or voids in the floor, as shown in more detail in FIG. 26, and into voids or ducts in a wall. The air then flows out through opening at 2730 back into interior space 2710. Fans may be provided as needed, although heating of air in the wall may be sufficient to facilitate air flow. If the system is used for cooling, the air flow is reversed. The intake is near the top of a wall not facing the sun, and the air is cooled during its travel through the floor. Preferably, large concrete masses in thermal contact with the ground are provided for cooling the air in this configuration.

Figure 28:
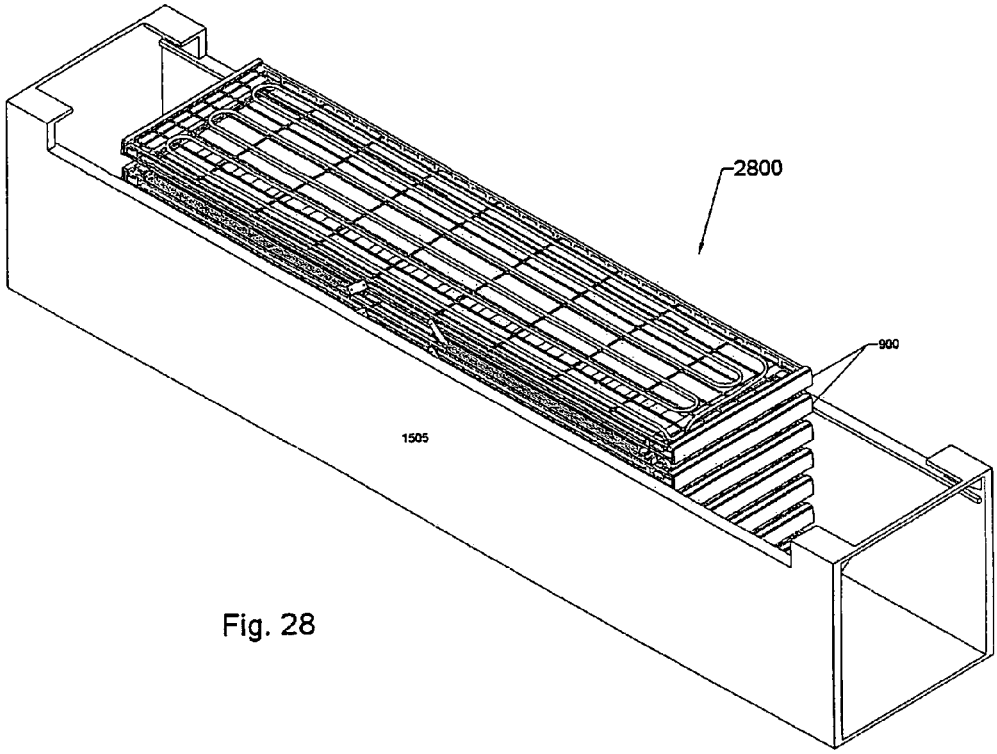
FIG. 28 is an isometric view of an article according to the invention in a container.

In FIGS. 28 to 31, the construction of a commercial building in accordance with the invention is illustrated. In FIG. 28, the components 900 making up a multi-story structure section 2800 are shown in their folded shipping position within a shipping container 1505, the top of which has been removed. The structure section 2800 is configured to include floor sections and wall sections within a container. The container may be a conventional shipping container, having dimensions of approximately 10' by 10' by 40', thereby facilitating transport of structure section 2800 by ship and rail.

Figure 29:
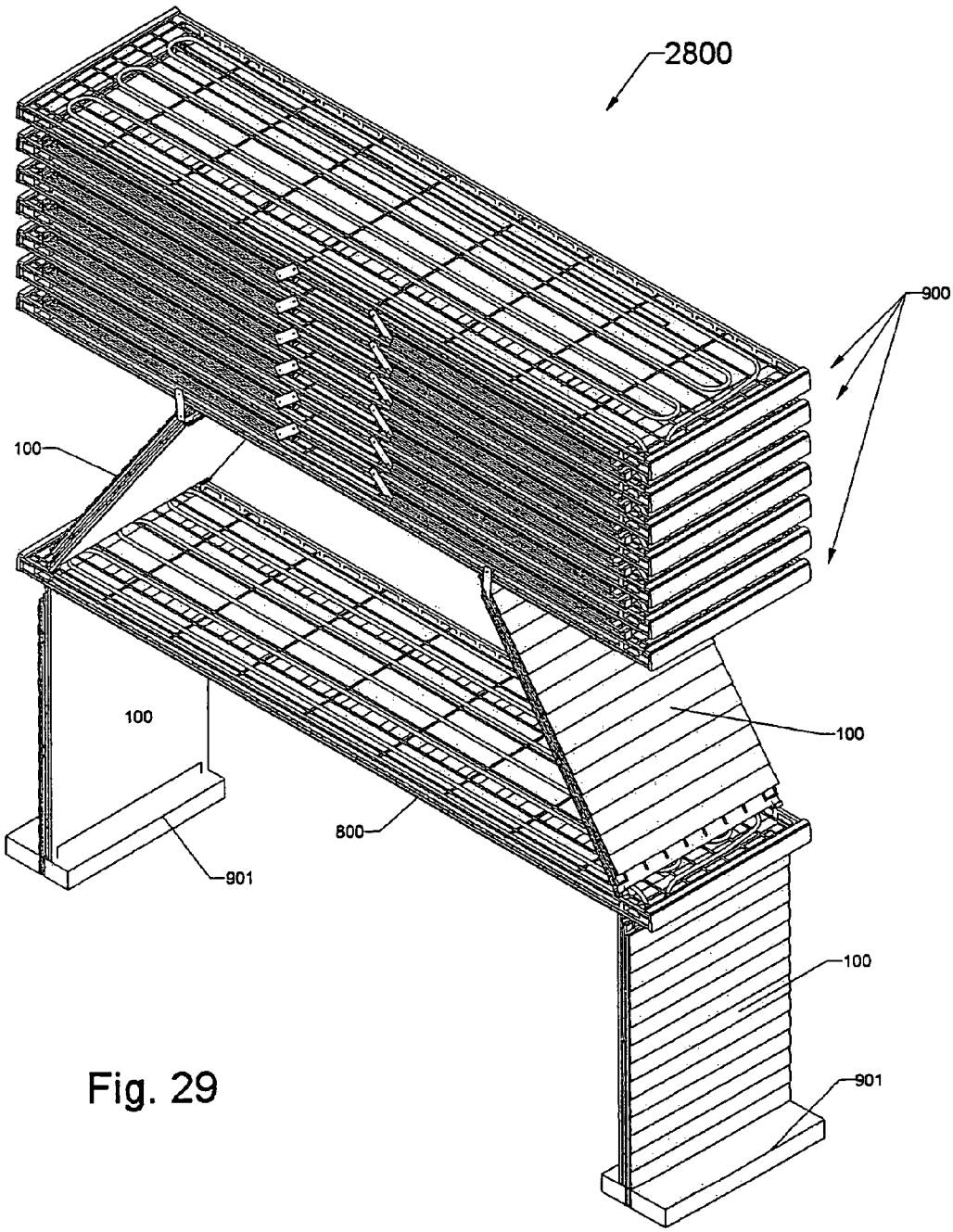
FIG. 29 is a view of an article of FIG. 28 in a partially open configuration.

Referring to FIG. 29, the container 1505 has been transported to a construction site, on which supporting pads 901 have already been provided. Other foundation structures may be provided, depending on such factors as the soil, calculated weight of the building when completed and occupied, need for hardening against earthquakes, and other factors. Structure section 2800 has been removed from its shipping container, such as by crane. The bottom wall sections 100 have been unfolded and situated on supporting pads 901, as well as secured relative to lowest floor section 800. The second level of wall sections 100 are shown partially unfolded, thus at an angle relative to lowest floor section 800, and partially translated and rotated relative to the next floor section 800. The remaining floor and wall sections are not unfolded. Concrete may be introduced into the lowest wall sections 100 and the lowest floor section 800 at this point. The concrete may then be permitted to set for a desired time or to a desired hardness before unfolding the next story fully. This process of unfolding, introducing concrete, permitting the concrete to set partially, and then further unfolding, may be repeated until the structure section 2800 is fully unfolded.

Figure 30:
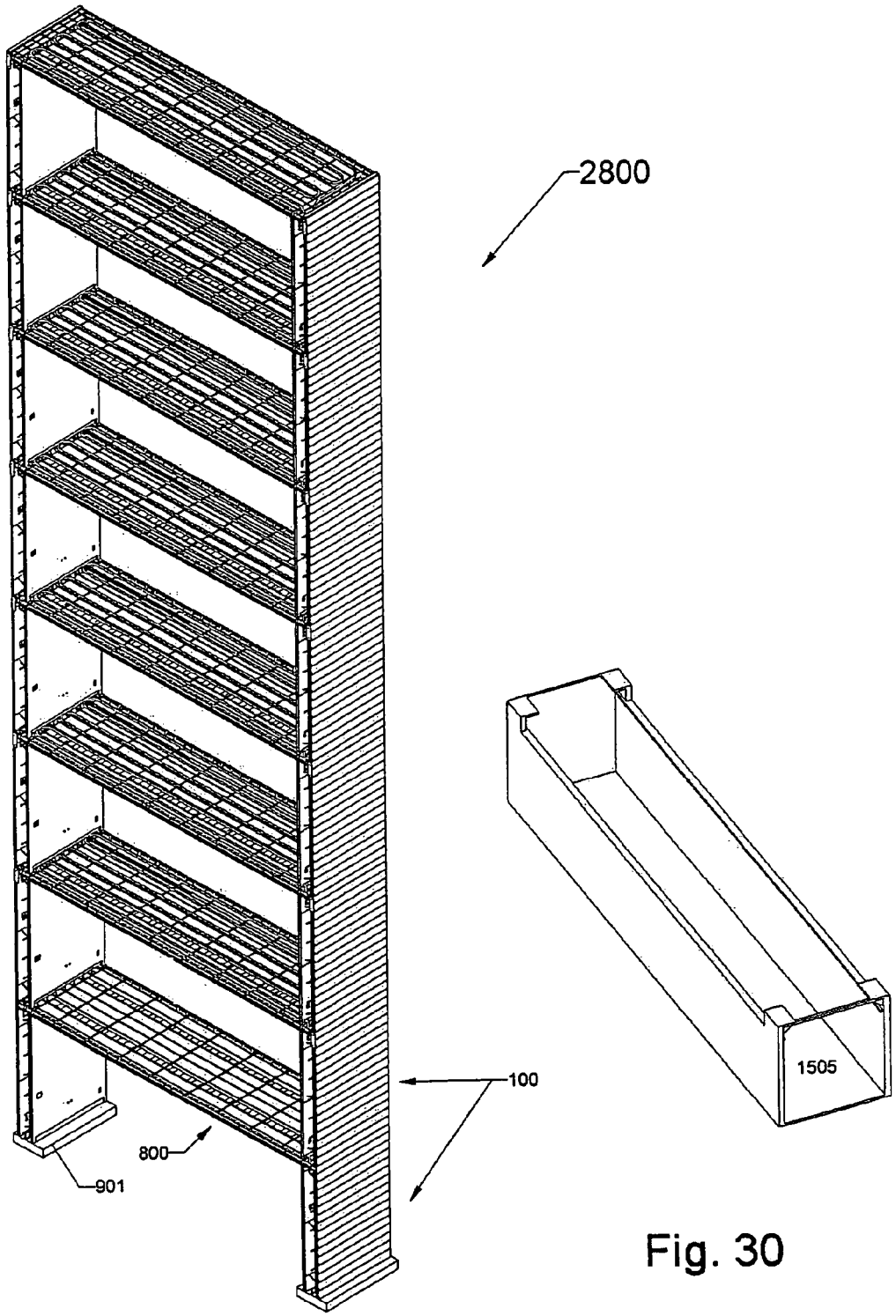
FIG. 30 is a view of an article of FIG. 28 in an assembled configuration.

In FIG. 30, structure section 2800 is shown in its fully unfolded or assembled orientation. All components 900 have been fully unfolded, the wall sections 100 and 800 have been locked. The structure is shown without concrete in place for ease of viewing.

Figure 31:
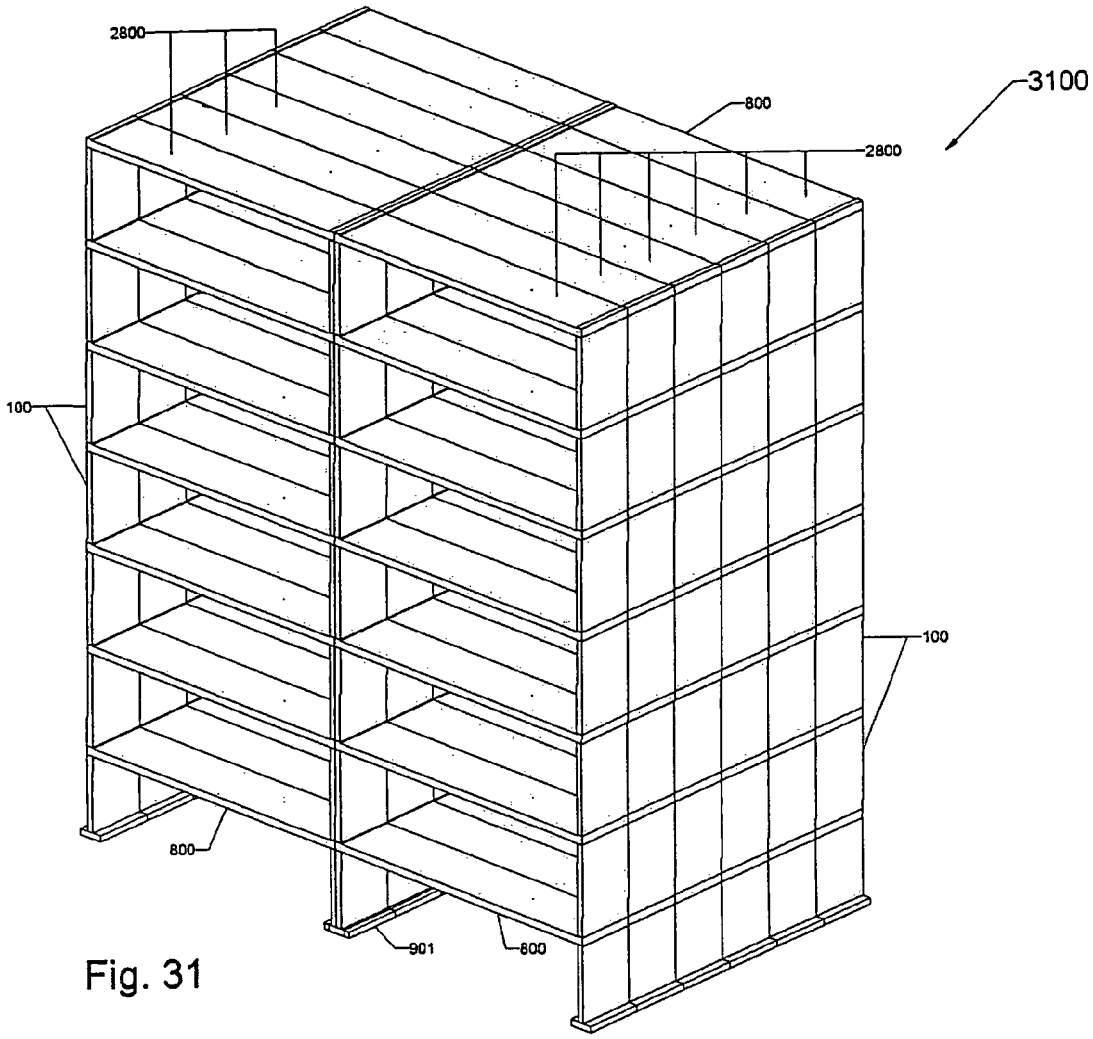
FIG. 31 is a schematic view of a building according to the invention.

In FIG. 31, an array of the components are shown, somewhat schematically, positioned to define a commercial structure 3100. It will be appreciated that features such as windows and interior doors in walls 100 and openings for stairs, elevators, and the like, in floor sections 800, may be introduced. In addition, prior to finishing, side walls and other features will be added. The number and arrangement of structure sections 2800 is exemplary, and any desired arrangement may be made. It will also be appreciated that the number of stories may be varied, and that structure sections of varying shapes may be employed. Structure sections 2800 may positioned next to existing buildings to augment existing buildings, as well as to provide new buildings.

Figure 32:
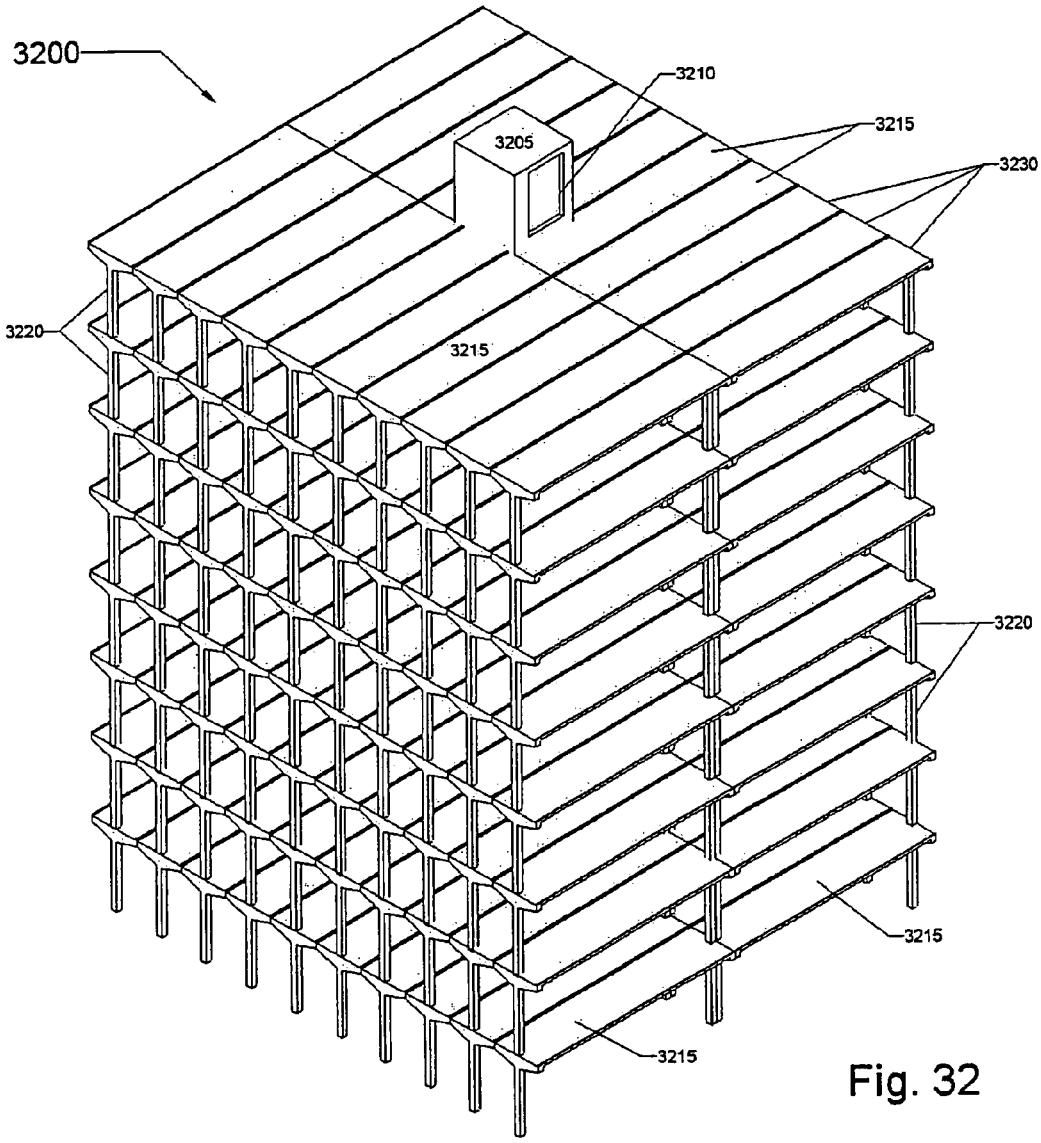
FIG. 32 is an isometric view of an alternative building according to the invention.

Referring to FIG. 32, an alternative embodiment of a commercial building 3200 is shown. The building is made up of structure sections 3230. Structure sections 3230 are generally similar to structure sections 2800 described above, but employ a structure having vertical posts 3230 in place of wall sections, and structural floor sections 3215. Building 3200 has an elevator shaft 3205. Elevator shaft 3205 may be constructed by conventional methods, and may be used to transport interior partitions, materials, interior finishes and concrete to the appropriate level. Door opening 3210 is shown, and is exemplary. It will be appreciated that the construction of FIG. 32 is particularly well suited for commercial buildings, such as hotels and office buildings.

Figure 33:
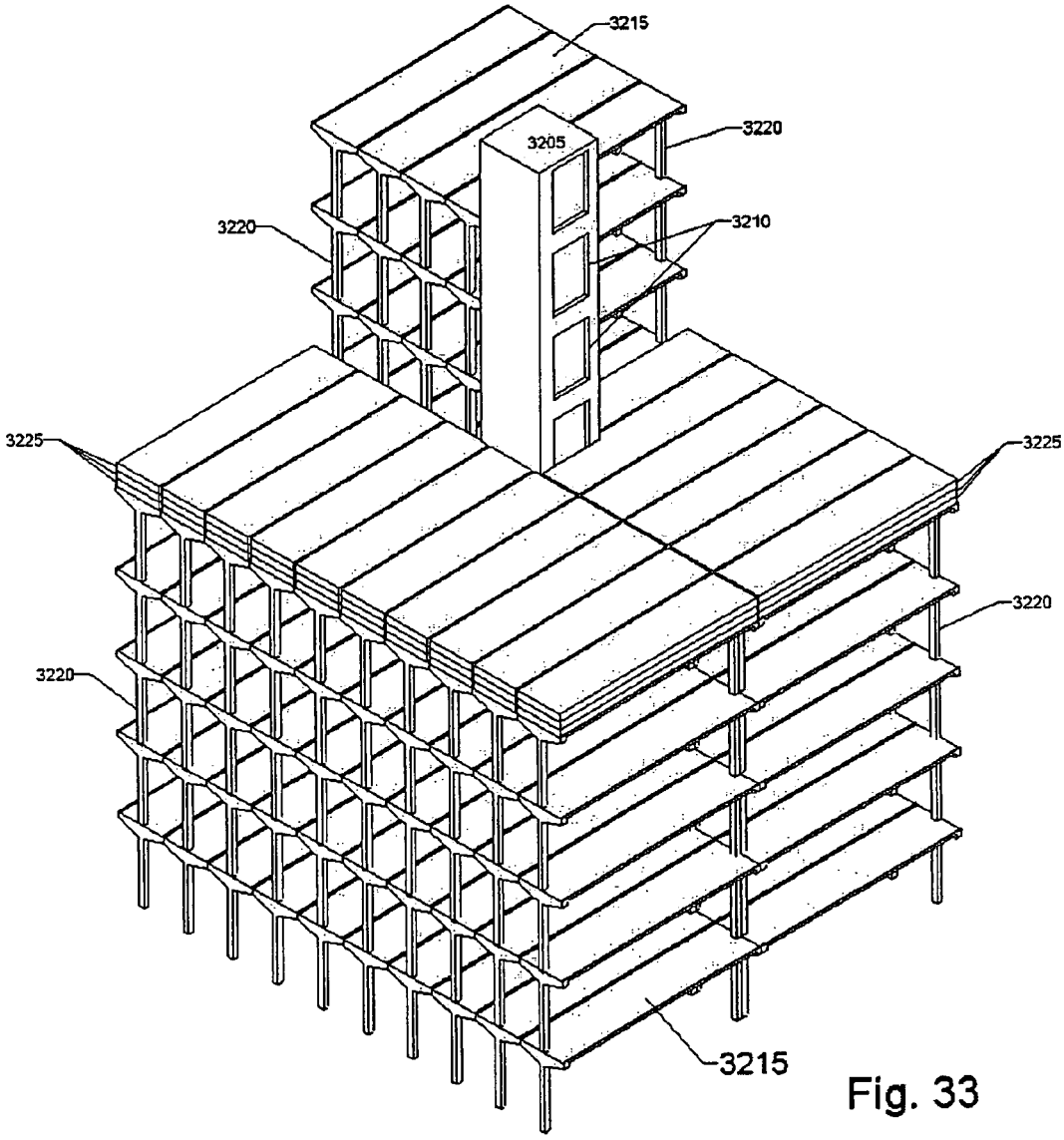
FIG. 33 is an isometric view of the building of FIG. 32 in a partially-assembled position.
Figures 34, 34A:
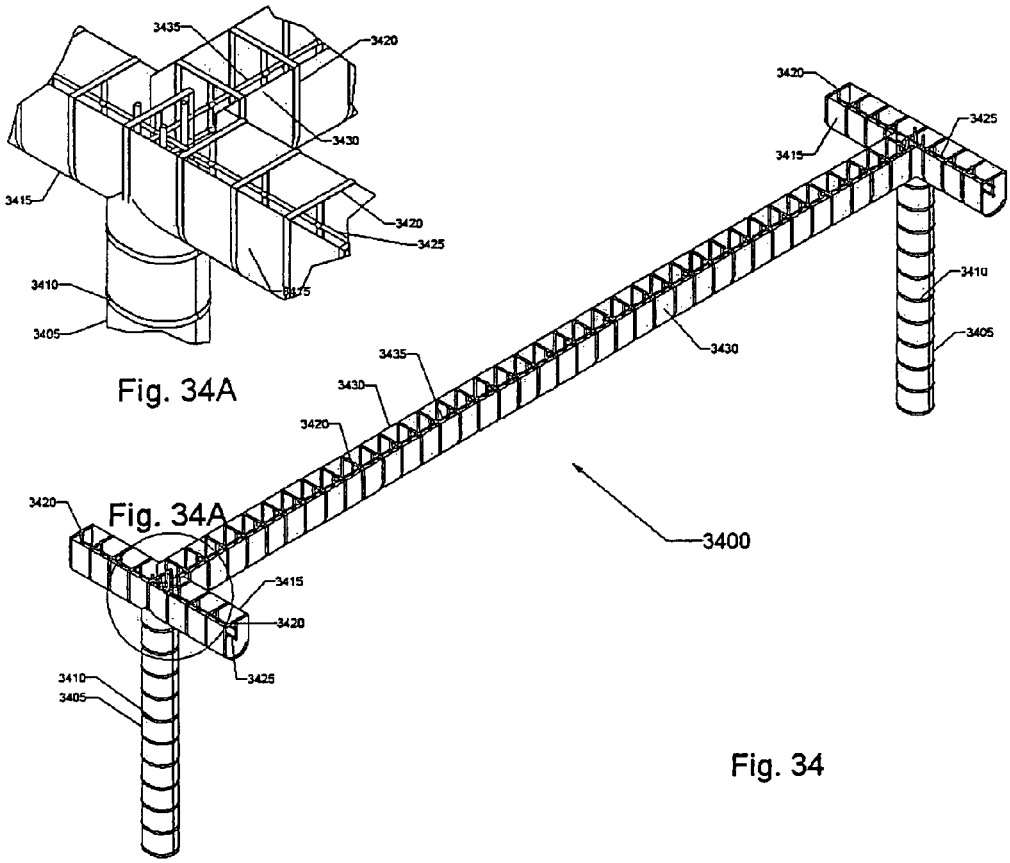
FIG. 34 is an isometric view of an article according to the invention.
FIG. 34A is a detailed partial view of the article of FIG. 34.

In FIG. 33, floor/post sections 3225 are shown stacked in place prior to being raised and having concrete introduced therein. As the post forms are flexible, they occupy very little vertical distance. Referring to FIG. 34, a fabric folding post and beam form is shown. The form 3400 is shown in a fully unfolded position. The form has upright post forms 3405 having fabric or other flexible generally cylindrical shape. In this example, two upright post forms 3405 are shown joined by a single elongated fabric beam form 3430. Additional upright post forms, with differing shapes, as well as additional beam forms, may be provided. Each upright post form 3405 is associated with a header form 3415. Stiffeners 3410 are provided in post forms 3405; stiffeners 3420 are provided in beam form 3430 and header forms 3415. Stiffeners may be made of a memory material that resumes its shape upon lifting of the floor section above. Rebar is provided in beams and headers at 3425 and 3435 for additional structural strength. It will also be appreciated that the diameter of the post or wall thickness may be varied as may the arrangement, number and size of the structural reinforcement. Structural sections of varying shapes and sizes may be employed to accommodate a variety of load carrying or code specific requirements.

Concrete and required equipment can be carried up via the elevator shaft as each floor is raised or by concrete pumping system or other suitable methods, thereby permitting completion of the next floor in each case, and avoiding the need for a crane. Multiple elevator shafts may be provided, and the size and shape of building sections may be varied to fit the selected design. The same technique may be employed using a crane as a replacement for or a supplement to an elevator.

Referring to FIG. 35A, an extruded structural post form 3500 is shown. Form 3500 may be formed from extruded plastic or other suitable material. Wall shapes 3505 and 3510 are selected to matingly engage in a folded format for shipping, as shown in FIG. 35C. The walls may be rotatably joined by flexible membranes. The form is shown in a configuration ready for pouring of concrete in FIG. 35A. The channels built into the form provide structural strength and may carry utilities and the like.

Figure 36:
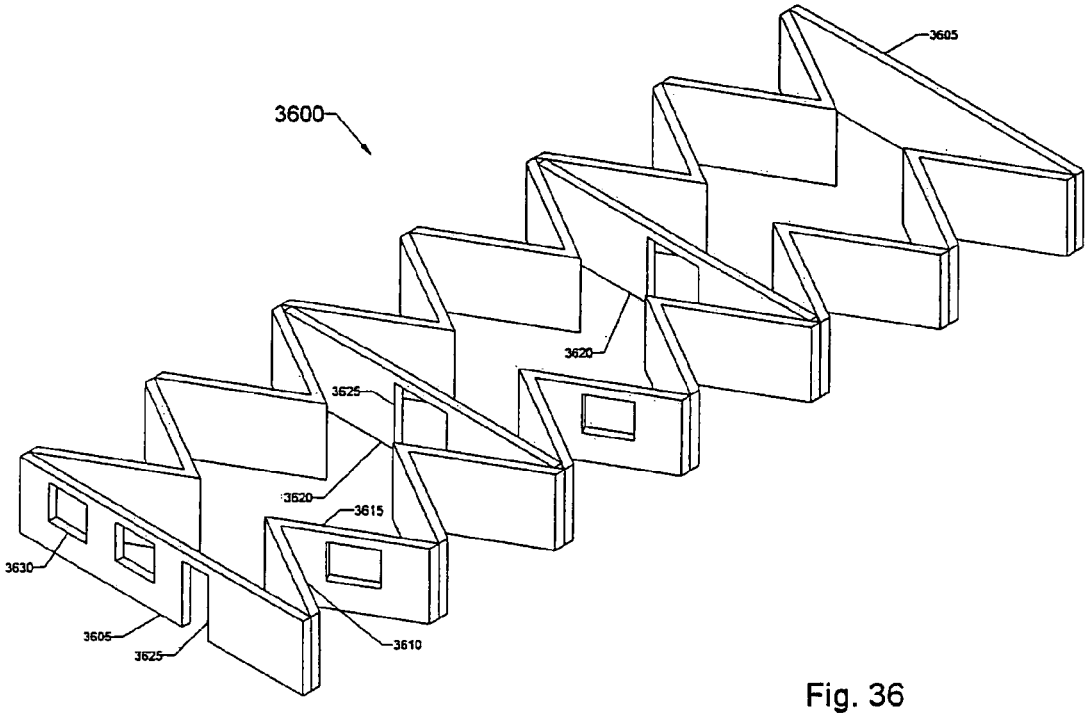
FIG. 36 is an isometric view of an alternative article according to the invention.

Referring to FIG. 36, a structure section 3600, shown somewhat schematically, folds horizontally. In this illustration, In this example, wall forms for a single floor of a structure may be arranged in a single container. An end wall form 3605 optionally has a door opening 3625 and window openings 3630. End wall form 3605 is preferably similar to wall form 100 described above, and may have any of the variations in structure and materials described above. End wall form 3605 has rotatably attached thereto, through suitable hinges or other mechanisms, side wall forms 3610, which do not provide for a window, and side wall forms 3615, which do provide for a window. At the opposite end of each side wall form 3610, 3615, a second side wall form is rotatably attached, and successive side wall forms are rotatably attached to one another. In this example, twelve side wall forms are provided, and the last is rotatably attached to an opposite end wall form 3605. Interior wall partition forms 3520, having exemplary openings 3625, are provided as well. Section 3600 may be fully folded and placed in containers for shipping, and then unfolded and locked into place. Suitable forms, similar to floor/ceiling form 900, may be employed to provide floors, ceilings and traverse structural supports.

Referring now to FIG. 37, there is shown an alternative article for providing ceiling elements in connection with the forms of FIG. 36. Lattice 3700 shown in FIG. 37 has transverse rebar rods 3710, with a U-shaped trough 3720 of fabric associated with rebar rods 3710, and longitudinal fabric 3730. As best seen in FIG. 37A, fabric strips 3720 may be folded for transport of lattice from a factory or other assembly location to a construction site. The longitudinal fabric is unrolled. The longitudinal fabric 3730 may be provided with devices to assure complete unrolling, such as internal cavities which may be filled with fluid to bring those to a particular dimension. The lattice is placed in position, supported by scaffolding, and the U-shaped fabric troughs 3720 are filled with concrete, with the rebar 3710 embedded in the concrete to provide a high-strength reinforced beam.

A wide variety of variations in the materials and configurations of a structure and method of the invention are within the scope of the invention. For example, any suitable materials may be employed. Appropriate substitutes for concrete and metal structural components may be employed. The number of stories of a structure may be selected depending on the weight to be borne and the properties of the structural members, and structures of more than two stories are possible. The dimensions of sections of structures may be varied as appropriate to suit differing cargo containers and vehicles. The dimensions of structural components can be varied as appropriate to meet the load bearing, load carrying or unsupported span requirements as required by site specific conditions or code requirements. Finish surfaces, utilities, and the like, may be applied at a factory location, or may be added at the assembly location. Rotatable and sliding connections may be employed, or various self-aligning features, may be employed to assist with the proper alignment of sections that are not connected. The types of rotatable connections may vary. The methods used to unfold the parts may vary widely, including the use of fork lifts, cranes, driven pulleys, lifts, and other mechanisms.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A section for use in construction of a building, comprising:

two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position, the interior space being adapted to receive flowable, setting material and permit said flowable, setting material to solidify in place; and a footing form positioned below said interior form surfaces, said footing form comprising a fabric and ribs having shape memory.

2. The section of claim 1, further comprising fabric intermediate said interior form surfaces to define a form for said flowable, setting material.

3. The section of claim 2, wherein said fabric-defined form comprises a form for a vertical cylindrical post.

4. The section of claim 2, wherein said fabric-defined form comprises a form for a header.

5. The section of claim 2, wherein said fabric-defined form comprises a form for a solid wall having an opening therethrough.

6. The section of claim 1, further comprising a rigid grid rotatably attached to and joining said interior form surfaces.

7. The section of claim 1, further comprising an interior finish surface.

8. The section of claim 1, further comprising an exterior finish surface.

9. The section of claim 1, further comprising rebar interior to said form surfaces.

10. The section of claim 1, further comprising at least one water pipe.

11. The section of claim 1, further comprising electrical wiring.

12. The section of claim 1, further comprising a ceiling comprising:

a substantially planar and continuous bottom form element;

components positioned on said bottom form element defining upright portions of a form, said components comprising adjustable components having a compact shipping orientation and an enlarged assembled orientation.

13. The section of claim 12, wherein said adjustable components comprise fluid bladders, said adjustable components being positioned to define troughs for formation of beams.

14. The section of claim 12, further comprising rebar.

15. The section of claim 12, further comprising an interior finish surface.

16. The section of claim 12, further comprising HVAC ductwork.

17. The section of claim 12, further comprising heating components.

18. A structure segment, comprising:

first and second wall sections, each of said wall sections having two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position;

a footing form positioned below said interior form surfaces, said footing form comprising a fabric and ribs having shape memory; and a first horizontal section rotatably attached to said first and second wall sections, said horizontal section comprising a substantially planar and continuous bottom form element and components positioned on said bottom form element defining upright portions of a form, said components comprising adjustable components having a compact shipping orientation and an enlarged assembled orientation.

19. The structure segment of claim 18, further comprising third and fourth wall sections rotatably attached to said first horizontal section, and a second horizontal section rotatably attached to said third and fourth wall sections.

20. A method of construction of a structure, comprising the steps of:

positioning at a construction location first and second wall sections, each of said wall sections having two opposing interior form surfaces, a shipping position in which the two interior form surfaces are relatively in close proximity, and an assembled position in which the two interior form surfaces are separated by a greater distance than in the shipping position, an interior space being defined between the interior form surfaces in the assembled position, and a first horizontal section rotatably attached to said first and second wall sections, said horizontal section comprising a substantially planar and continuous bottom form element and components positioned on said bottom form element defining upright portions of a form, said components comprising adjustable components having a compact shipping orientation and an enlarged assembled orientation;

orienting said first and second wall sections and said first horizontal section in their assembled orientations;

defining a footing form beneath at least said first wall section, said footing form comprising a fabric and ribs having shape memory;

inserting a flowable structural material into said first and second wall sections and said first horizontal section, and permitting said flowable structural material to cure; and filling said footing form with said flowable structural material substantially simultaneously with said step of inserting said flowable structural material.

21. The method of claim 20, wherein said flowable structural material is concrete.

22. The method of claim 20, wherein said footing form comprises parallel planar surfaces.

23. The method of claim 20, wherein said first wall section is supported at a selected height and orientation independent of said footing form.

24. The method of claim 20, further comprising the step of positioning, adjacent to said first and second wall sections and said first horizontal sections, second and third wall sections and a second horizontal section.

25. The method of claim 20, wherein said first horizontal section is positioned below said first and second wall sections, a continuous void is defined in said first horizontal section and at least said first wall section, said void having first and second interior openings, a solid mass is defined adjacent said continuous void in at least one of said wall sections or said first horizontal section, whereby circulation of air into said first interior opening, through said void and out said second interior opening provides air temperature control.

26. A method of construction of a structure, comprising the steps of:

positioning at a construction location, while in a compact shipping position, a plurality of structure sections, said structure sections being positioned in an array; each of said structure sections comprising a plurality of wall sections and a plurality of floor/ceiling sections; and a footing form positioned below at least one of said structural sections having, said footing form comprising a fabric and ribs having shape memory;

moving each of said structure sections from said compact shipping position to an assembled position; and introducing a flowable, setting material into said structure sections, and permitting said material to set;

whereby said array of structure sections defines a structure, supported by said setting material.

27. A method of construction of a structure, comprising the steps of:

positioning at a construction location, while in a compact shipping position, a plurality of structure sections, said structure sections being positioned in an array; each of said structure sections comprising floor/ceiling sections and post and beam forms; said floor/ceiling sections each comprising a substantially planar and continuous bottom form element and components positioned on said bottom form element defining upright portions of a form, said components comprising adjustable components having a compact shipping orientation and an enlarged assembled orientation; said post and beam forms comprising an extruded structural post form having relatively movable walls having a folded format and an assembled format to provide a compact shipping orientation and an enlarged assembled orientation;

moving each of said structure sections from said compact shipping position to an assembled position; and introducing a flowable, setting material into said structure sections, and permitting said material to set;

whereby said array of structure sections defines a structure, supported by said setting material, and comprising posts and beams.

28. The method of claim 27, wherein said post and beam forms comprise fabric forms having shape memory material.

29. The method of claim 28, wherein at least one of said fabric forms comprises rebar.

* * * * *